US010165916B2

(12) United States Patent
Morphey et al.

(10) Patent No.: US 10,165,916 B2
(45) Date of Patent: Jan. 1, 2019

(54) VACUUM CLEANER BASE ASSEMBLY AND AIR PASSAGE SYSTEM

(71) Applicant: MIDEA AMERICA, CORP., Parsippany, NJ (US)

(72) Inventors: John Curtis Morphey, Concord, NC (US); Alexander Douglas Goare, Charlotte, NC (US); Donald Joseph Davidshofer, Mount Holly, NC (US)

(73) Assignee: MIDEA AMERICA, CORP., Parsippany, NJ (US)

( * ) Notice: Subject to any disclaimer, the term of this patent is extended or adjusted under 35 U.S.C. 154(b) by 686 days.

(21) Appl. No.: 14/014,973

(22) Filed: Aug. 30, 2013

(65) Prior Publication Data

US 2014/0157542 A1 Jun. 12, 2014

Related U.S. Application Data

(63) Continuation of application No. 13/789,895, filed on Mar. 8, 2013, which is a continuation-in-part of (Continued)

(51) Int. Cl.
*A47L 9/00* (2006.01)
*A47L 5/28* (2006.01)
(Continued)

(52) U.S. Cl.
CPC ..... *A47L 5/28* (2013.01); *A47L 9/0009* (2013.01); *A47L 9/02* (2013.01); *A47L 9/32* (2013.01); *A47L 9/325* (2013.01); *A47L 9/22* (2013.01)

(58) Field of Classification Search
CPC ..... A47L 5/34; A47L 9/00; A47L 9/32; A47L 9/325; A47L 9/009; A47L 5/28
(Continued)

(56) References Cited

U.S. PATENT DOCUMENTS 2,039,861 A 5/1936 Watts
2,103,101 A 12/1937 Taylor
(Continued)

FOREIGN PATENT DOCUMENTS

CN 1493245 5/2004
CN 1611173 5/2005
(Continued)

OTHER PUBLICATIONS

Office Action dated Jun. 8, 2015 for U.S. Appl. No. 13/789,895.
(Continued)

*Primary Examiner* — Bryan R Muller
(74) *Attorney, Agent, or Firm* — Hodgson Russ LLP

(57) ABSTRACT

A vacuum cleaner having a handle, a dirt separator and suction motor on the handle, and a nozzle. An elongated suction inlet passes through the bottom face of the nozzle, and a pivot joins the nozzle to the handle at a pivot axis that extends parallel to the elongated suction inlet. The pivot includes first and second pivot connections joining the base to either side of the handle. A base air passage extends from the suction inlet to the first pivot connection, and is fluidly connected, through the first pivot connection, to a first handle air passage located in the handle and extending from the first pivot connection to an inlet of the separator. A second handle air passage located in the handle extends from the separator outlet to the suction motor inlet.

33 Claims, 11 Drawing Sheets

Related U.S. Application Data application No. 13/712,512, filed on Dec. 12, 2012, now Pat. No. 9,345,371.

(51) Int. Cl.
*A47L 9/32* (2006.01)
*A47L 9/02* (2006.01)
*A47L 9/22* (2006.01)

(58) Field of Classification Search
USPC ..... 15/359, 410
See application file for complete search history.

(56) References Cited

U.S. PATENT DOCUMENTS 2,289,711 A 7/1942 Kirby
2,381,710 A 8/1945 Arnhym
2,409,082 A 10/1946 Troxler
2,416,420 A 2/1947 Taylor
2,446,985 A 8/1948 Shumaker
2,524,117 A * 10/1950 Storm, Jr. ..... A47L 5/14 15/331
2,581,962 A 1/1952 Langille et al.
2,583,054 A 1/1952 Kirby
2,672,643 A 3/1954 Langille
2,753,585 A 7/1956 Eberhart
2,850,757 A 9/1958 Duff
2,881,465 A 4/1959 Duff
2,898,621 A * 8/1959 Vance ..... A47L 5/32 15/324
2,898,622 A 8/1959 Hurd
3,002,217 A 10/1961 Smithson et al.
3,012,267 A 12/1961 Kemnitz
3,031,710 A 5/1962 Huening, Jr.
3,039,129 A 6/1962 Belicka et al.
3,199,138 A 8/1965 Nordeen
3,217,351 A 11/1965 Hayba
3,512,207 A 5/1970 Ettridge
3,618,687 A * 11/1971 Ripple ..... A47L 5/30 15/340.2
3,639,941 A 2/1972 Kirwan et al.
3,675,268 A 7/1972 Nordeen
3,676,892 A 7/1972 Nordeen
3,683,449 A * 8/1972 Nordeen ..... A47L 9/325 15/410
3,802,026 A 4/1974 OlofCrener
3,821,831 A 7/1974 Grover
3,827,103 A * 8/1974 Nordeen ..... A47L 5/34 15/359
3,855,666 A 12/1974 Erikson et al.
3,932,912 A * 1/1976 Johnson ..... A47L 9/325 15/410
3,952,363 A 4/1976 Lindman
4,014,068 A 3/1977 Payne et al.
4,078,275 A 3/1978 Baird
4,167,799 A 9/1979 Webb
4,171,554 A 10/1979 Tschudy
4,174,554 A 11/1979 Flantua
4,180,887 A 1/1980 Wudel et al.
4,376,322 A 3/1983 Lockhart et al.
4,423,534 A 1/1984 Lyman et al.
4,446,594 A 5/1984 Watanabe et al.
4,573,236 A 3/1986 Dyson
4,592,111 A 6/1986 Berfield
4,593,429 A 6/1986 Dyson
4,782,552 A 11/1988 Bartlett et al.
4,905,341 A * 3/1990 Sunagawa ..... A47L 5/30 15/323
4,959,885 A * 10/1990 Sovis ..... A47L 5/34 15/323
5,042,109 A 8/1991 Stephens
5,086,538 A 2/1992 Zahuranec
5,093,956 A * 3/1992 Saunders ..... A47L 5/32 15/327.1
5,255,411 A * 10/1993 Da Costa ..... A47L 5/34 15/333
5,269,042 A 12/1993 Stephens et al.
5,279,018 A * 1/1994 Glenn, III ..... A47L 9/22 15/351
5,347,678 A 9/1994 Williams et al.
5,353,471 A 10/1994 Guhne et al.
5,414,893 A * 5/1995 Hampton ..... A47L 5/30 15/351
5,475,893 A 12/1995 Sepke
5,551,120 A 9/1996 Cipolla et al.
5,560,074 A * 10/1996 Graham ..... A47L 5/32 15/323
5,819,370 A 10/1998 Stein
5,906,024 A 5/1999 Jailor et al.
5,970,576 A 10/1999 Maurer et al.
5,974,625 A 11/1999 Garner
6,006,401 A 12/1999 Jailor et al.
6,081,963 A 7/2000 Jailor et al.
6,123,779 A 9/2000 Conrad et al.
6,131,238 A 10/2000 Weber et al.
6,134,744 A 10/2000 Kasen et al.
6,146,434 A 11/2000 Scalfani et al.
6,158,084 A 12/2000 Weber et al.
6,243,917 B1 6/2001 Conrad
6,261,379 B1 7/2001 Conrad et al.
6,391,095 B1 5/2002 Conrad et al.
6,571,424 B2 6/2003 Roschi et al.
6,591,447 B2 7/2003 Wegelin et al.
6,772,474 B2 8/2004 Nishokori et al.
6,934,993 B1 8/2005 Huffman et al.
6,957,473 B2 10/2005 Nishikori et al.
RE39,304 E 9/2006 Kasen et al.
7,203,993 B2 4/2007 Tondra et al.
7,246,405 B2 7/2007 Yan
7,246,407 B2 7/2007 Park et al.
7,266,861 B2 9/2007 Stein et al.
7,290,308 B2 11/2007 Downey et al.
7,310,855 B2 12/2007 Blocker et al.
7,340,798 B2 3/2008 Nishikori et al.
7,350,266 B2 4/2008 Park et al.
7,353,563 B2 4/2008 Blocker et al.
7,549,190 B2 6/2009 Oh et al.
7,599,758 B2 10/2009 Reindle et al.
7,676,883 B2 3/2010 MacLeod et al.
7,797,792 B2 9/2010 Cipolla et al.
7,895,707 B2 3/2011 Moon
7,921,509 B2 4/2011 Oh et al.
8,037,571 B2 10/2011 Butts et al.
8,060,980 B2 11/2011 Mayes et al.
8,082,624 B2 12/2011 Myers
8,387,206 B2 3/2013 Arthey et al.
8,387,207 B2 3/2013 Dimbylow et al.
8,448,295 B2 5/2013 Vines et al.
8,510,908 B2 8/2013 Maguire et al.
8,539,636 B2 9/2013 White et al.
8,631,541 B2 1/2014 Tran
2006/0005350 A1 1/2006 Kim
2006/0070209 A1 4/2006 Fischer et al.
2007/0245514 A1* 10/2007 Luebbering ..... A47L 5/32 15/410
2008/0289141 A1 11/2008 Oh et al.
2009/0056066 A1* 3/2009 Becker ..... A47L 5/34 15/383
2009/0276975 A1 11/2009 Vines
2009/0307867 A1 12/2009 Bernard et al.
2010/0236019 A1 9/2010 Behrenswerth
2012/0124769 A1 5/2012 Krebs et al.

FOREIGN PATENT DOCUMENTS

CN 101961225 2/2011
DE 19632800 5/2011
DE 10305276 6/2013
EP 0792612 9/1997
EP 0793938 1/2003
EP 1396222 4/2010
GB 401458 A * 11/1933 ..... A47L 9/242

(56) References Cited

FOREIGN PATENT DOCUMENTS

| | | |
|---|---|---|
| GB | 506512 | 5/1939 |
| GB | 584413 | 1/1947 |
| GB | 1320191 | 6/1973 |
| GB | 2336992 | 11/1999 |
| JP | 06292646 | 10/1994 |
| JP | 08280586 | 10/1996 |
| JP | 08299230 | 11/1996 |
| JP | 2000279353 | 10/2000 |
| JP | 2009112434 | 5/2009 |
| KR | 20040100146 | 12/2004 |

OTHER PUBLICATIONS

Office Action dated Oct. 8, 2015 for U.S. Appl. No. 13/712,512.
Office Action dated Oct. 21, 2015 for U.S. Appl. No. 13/712,512.
Office Action dated Nov. 18, 2015 for U.S. Appl. No. 13/789,895.
Notice of Allowance dated Mar. 25, 2016 for U.S. Appl. No. 13/712,512.
Entire patent prosecution history of U.S. Appl. No. 13/712,512, filed Dec. 12, 2012, entitled, "Vacuum Cleaner Base Assembly."
Entire patent prosecution history of U.S. Appl. No. 13/789,895, filed Mar. 8, 2013, entitled, "Vacuum Cleaner Base Assembly."
Combined Search and Examination Report for GB1306707.9 dated Aug. 20, 2013.
Combined Search and Examination Report for Application No. GB1306707.9 dated Aug. 20, 2013.
Fantom Fury Parts Manual. Undated, but admitted to be prior art.

* cited by examiner

VACUUM CLEANER BASE ASSEMBLY AND AIR PASSAGE SYSTEM

CROSS REFERENCE TO RELATED APPLICATION

This is U.S. application is a continuation of U.S. application Ser. No. 13/789,895 filed Mar. 8, 2013 which is a continuation-in-part of U.S. application Ser. No. 13/712,512 filed Dec. 12, 2012.

BACKGROUND OF THE INVENTION

Field of the Invention

The present invention relates to upright vacuum cleaners having a base to which a handle is pivotally mounted. In particular respects, the disclosure relates to a base construction that permits free rotational movement of the airflow-carrying portion of the base.

Description of the Related Art

Vacuum cleaners have been provided in a variety of configurations. One common type is the upright vacuum cleaner, which has a base that moves on the floor, and a handle pivotally mounted to the base. The base includes a suction inlet that faces the floor. A vacuum fan and motor assembly ("suction motor") is located in either the base or the handle, and fluidly connected to the inlet to generate a suction flow of air to draw in dirt and debris. A dirt collection device, such as a filter bag or inertial (e.g., cyclonic) separator, is provided in the base or, much more frequently, in the handle. In use, the handle is leaned back and manipulated to direct the base over the floor in a series of back-and-forth motions. The upright vacuum cleaner is stored by pivoting the handle to an upright position, where it remains by gravity (if leaned forward somewhat to put the center of gravity in front of the pivot axis) or with the help of an upright handle lock mechanism. The vacuum cleaner is also sometimes placed in the upright position during use, such as when the suction motor is connected to an auxiliary cleaning hose.

It is desirable to make sure the handle lock mechanism does not permit unwanted tipping, as such can be inconvenient and may cause damage. In more recent years, it has become increasingly common to position both the suction motor and the dirt collection device in the handle. This places more weight on the handle, and makes it even more important to securely hold the handle in the upright position. Typical handle lock mechanisms use a compact pedal-operated latch on the base, which engages a corresponding hole or shelf on the handle. Examples of such devices are shown in U.S. Pat. Nos. 4,423,534 and 6,006,401, which are incorporated herein by reference. Other handle locks use spring-loaded pins or shafts to retain the handle using an articulated spring-and-catch system that permits rotation after a sufficient force has been applied to press the spring-loaded catch out of engagement. Examples of these devices are shown in U.S. Pat. No. 5,353,471 and U.S. Publication No. 2009/0276975, which are incorporated herein by reference. In devices having a relatively heavy handle, the lock may be fairly robust to bear the weight of the handle, and multi-part spring-and-catch systems can be complicated and expensive to produce.

The base of a typical upright vacuum cleaner comprises a relatively robust structure that holds supporting wheels and the main suction inlet, and carries the entire weight of the handle. Height adjustment mechanisms have been provided to adjust the height of the suction inlet relative to the floor to thereby enhance performance on various different surfaces, ranging from hardwood floors to thick carpets. Height-adjustment devices typically comprise a small wheel assembly, located just behind the suction inlet, that is moved up and down relative to the rest of the base to raise and lower the suction inlet. The wheel assembly typically bears a large portion of the base's weight, and is the first structural part of the device to strike obstacles on the floor, and therefore must be fairly strong and durable.

FIG. 7 illustrates a typical prior art upright vacuum cleaner 700. The vacuum cleaner 700 has a base 702 and a handle 704 pivotally mounted on the base 702 to rotate about a pivot axis 706. The base 702 includes rear wheels 708 and front wheels 710, which provide the primary support function to hold the vacuum cleaner 700 during storage and use. The front wheels 710 may be mounted on a wheel carriage 712 that rotates to raise and lower a suction inlet 714 located at the front of the base 702. For example, lowering the front wheels 710 relative to the rest of the base 702 raises the suction inlet 714 relative to a surface 716 upon which the wheels 708, 710 rest. In this typical construction, the base 702 comprises a unitary rigid structure that joins the front and rear wheels 710, 708, handle pivot 706 and suction inlet 714. Such a design has long been considered favorable because it provides strength, simplicity, and low manufacturing cost. In use, the user pushes the vacuum cleaner 700 forward by applying an operating force $F_1$ to the handle 704, and then pulling backwards with an opposite force. It is now believed that such devices have dynamic characteristics that can, under some circumstances, lead to more difficult operation.

While various features of upright vacuum cleaners like the ones described above have been used in the art, there still exists a need to provide alternatives to such devices.

SUMMARY

In one exemplary embodiment, there is provided a vacuum cleaner having a handle, a dirt separator mounted on the handle, a suction motor mounted in the handle, and a nozzle pivotally mounted on the handle. The handle has a first handle side and a second handle side opposite the first handle side. The dirt separator has a separator inlet for receiving dirt-laden air and a separator outlet for discharging cleaned air. The suction motor mounted has a suction motor inlet configured to generate a suction airflow into the suction motor inlet. The nozzle has a bottom face, a first side region that extends along the first handle side, and a second side region that extends along the second handle side to thus locate at least a portion of the handle between the first side region and the second side region. A suction inlet passes through the bottom face of the nozzle. The suction inlet includes an opening that is elongated along a suction inlet axis extending from the first side region to the second side region. A pivot joins the nozzle to the handle at a pivot axis that extends from the first side region of the nozzle to the second side region of the nozzle and in parallel with the suction inlet axis. The pivot includes a first pivot connection joining the first side region to the first handle side, and a second pivot connection joining the second side region to the second handle side. A base air passage extends from the suction inlet to the first pivot connection. A first handle air passage is located in the handle and extends from the first pivot connection to the separator inlet. The first handle air passage is fluidly connected to the base air passage through the first pivot connection. A second handle air passage is located in the handle and extends from the separator outlet to the suction motor inlet.

In another exemplary embodiment, there is provided a vacuum cleaner having a handle, a dirt separator mounted to the handle, a suction motor mounted in the handle, and a nozzle pivotally mounted on the handle. The handle has an upper end, a lower end, a first handle side, and a second handle side opposite the first handle side. The dirt separator has a separator inlet for receiving dirt-laden air and a separator outlet for discharging cleaned air. A handle air passage is formed in the handle, and has a handle air passage inlet located at the first handle side at the lower end of the handle, and a handle air passage outlet connected to the separator inlet. The suction motor has a suction motor inlet connected to the separator outlet. The nozzle includes a nozzle shell having a bottom face with an elongate suction inlet passing through the bottom face of the nozzle shell, a first side arm that extends backwards from the suction inlet and pivotally connects the nozzle shell to the first handle side at the lower end of the handle, and a second side arm that extends backwards from the suction inlet and pivotally connects the nozzle shell to the second handle side at the lower end of the handle. A nozzle air passage is formed in the first side arm. The nozzle air passage extends backwards from the suction inlet to the first handle side at the lower end of the handle, and has a nozzle air passage inlet connected to the elongate suction inlet, and a nozzle air passage outlet connected to the handle air passage inlet, so that the suction motor draws dirt-laden air into the suction inlet, through the nozzle air passage and the handle air passage and into the dirt separator.

The recitation of this summary of the invention is not intended to limit the claims of this or any related or unrelated application. Other aspects, embodiments, modifications to and features of the claimed invention will be apparent to persons of ordinary skill in view of the disclosures herein.

BRIEF DESCRIPTION OF THE DRAWINGS

A better understanding of the exemplary embodiments may be understood by reference to the attached drawings, in which like reference numbers designate like parts. The drawings are exemplary and not intended to limit the claims in any way.

DETAILED DESCRIPTION

The exemplary embodiments described herein relate to upright vacuum cleaners and more specifically to various features of the bases of such vacuum cleaners.

Figure 1:
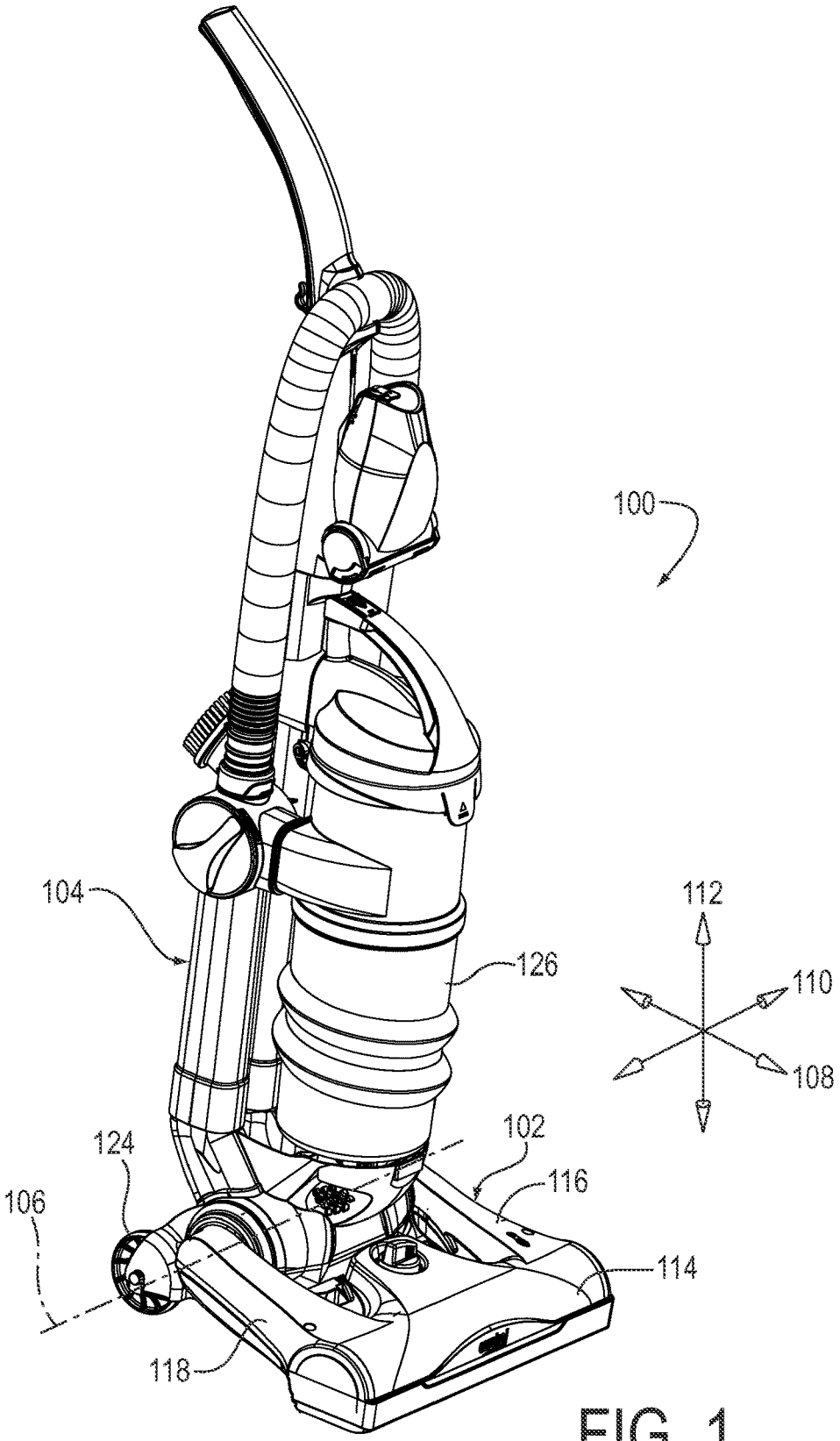
FIG. 1 is an isometric view of an exemplary embodiment of an upright vacuum cleaner incorporating one or more aspects of the present invention.

An exemplary embodiment of an upright vacuum cleaner 100 is shown in FIG. 1. The vacuum cleaner 100 includes a base 102 and a handle 104 pivotally mounted to the base 102 to rotate about a handle pivot axis 106. The base 102 comprises a lower assembly of parts, and the handle 104 comprises an assembly of parts, and together they form a self-contained vacuum cleaning unit. The handle 104 may include a grip, storage for accessory tools, a removable cleaning hose and associated wand, and other typical features of upright vacuum cleaners.

For convenience, the positional relationships of the various parts of the vacuum cleaner 100 are described herein with reference to their orientation when the base 102 is placed on a horizontal surface being cleaned. The fore-aft direction, indicated by arrow 108, lies in the horizontal plane and is the primary movement direction during cleaning. The terms "front," "rear," and the like relate to respective positions in the fore-aft direction 108. The lateral direction, as indicated by arrow 110, is perpendicular to the fore-aft direction 108, but within the horizontal plane. The terms "left," "right," "side," and the like refer to positions in the lateral direction 110. The vertical direction, as indicated by arrow 112, is orthogonal to the horizontal plane and, thus, to both the fore-aft direction 108 and lateral direction 110. The terms "up," "down," "above," "below," and the like refer to positions in the vertical direction 112. It will be appreciated that these terms are used for convenience, and not to delineate strict and exclusive positional relationships. For example, an object that is said to be "above" another part need not be directly above that part in the vertical direction 112, but instead can also be offset in one or both of the other directions. Similarly, a part that extends "vertically" or in the "forward" direction may also extend in another direction.

The base 102 includes an inlet nozzle 114 located in front of the pivot axis 106. The inlet nozzle 114 includes a downward-facing inlet 206 (FIG. 2) to which a suction flow is directed to lift dirt and debris from the surface being cleaned. A brushroll 208 (FIG. 2) or other conventional agitator may be provided in the inlet nozzle 114 to assist with cleaning. The base 102 includes a left side region 116 and a right side region 118 that have an opening between them to receive the bottom of the handle 104. The bottom of the handle 104, in this case, comprises a motor housing in which a suction motor 328 (FIG. 3B) is contained. The base 102 also may have one or more wheels 124 or other supports, such as rolling balls, skid plates and the like.

The suction motor 328, which may alternatively be located in the base 102 or other parts of the handle 104, is connected to the inlet nozzle 114 by a system of one or more air passages. The air passage system also connects to one or more dirt collection devices 126, such as a cyclone separator, filter bag, pleated or panel filter, or the like. The dirt collection devices 126 may be upstream or downstream of the suction motor 328, or both. The dirt collection device may integrated in the vacuum cleaner 100 (as in the case of a non-removable chamber for a filter bag) or connectable to the rest of the vacuum cleaner 100 (as in the case of typical removable cyclone separator units). The details of such dirt collection devices 126 are well-known in the art and not the immediate subject of this application, and thus are not described in detail herein.

Figure 2:
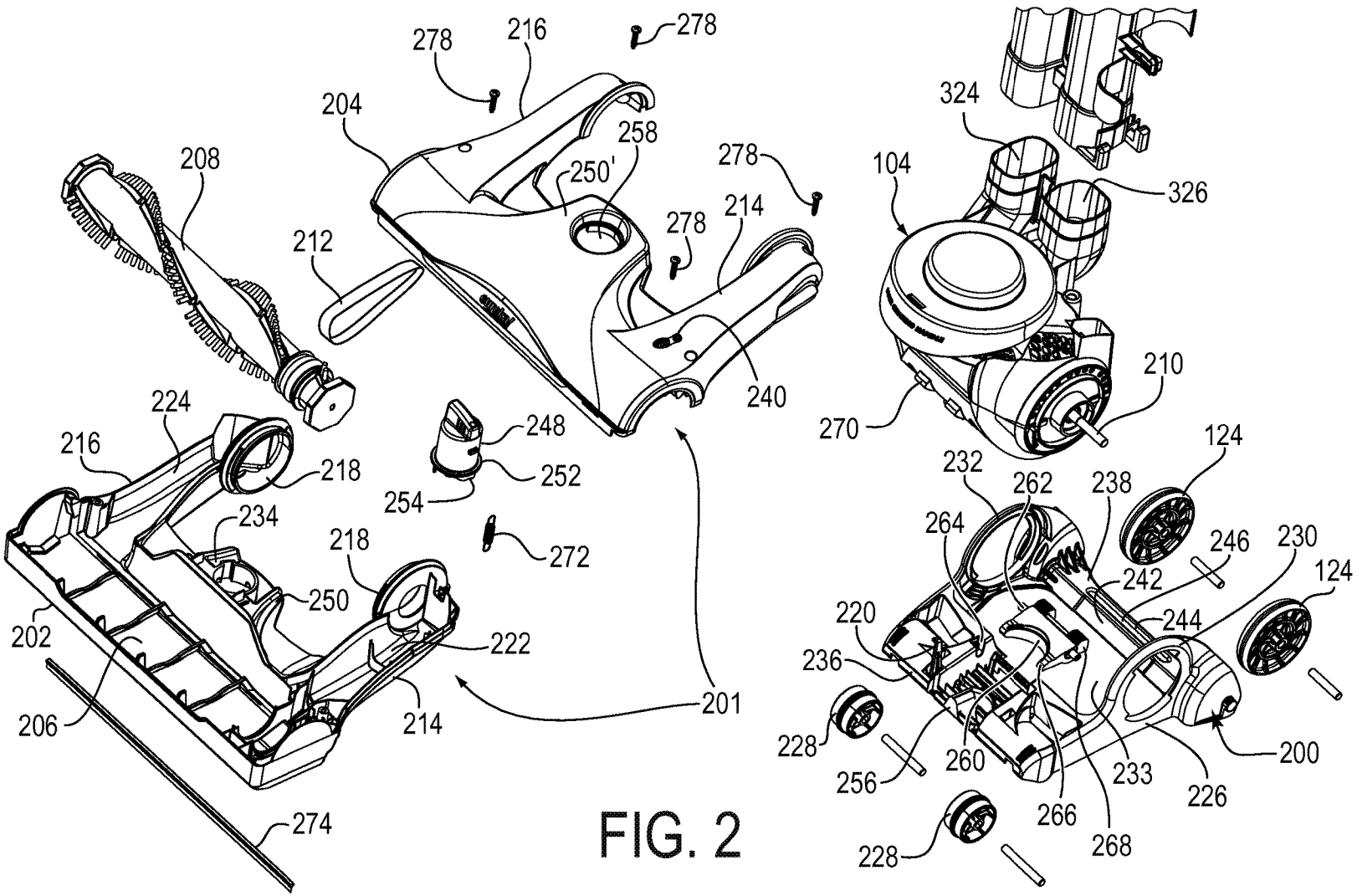
FIG. 2 is an exploded view of the base and a portion of the handle of the vacuum cleaner of FIG. 1.

FIG. 2 is an exploded view of an exemplary base 102 and the lower portion of the handle 104. The base 102 generally includes a carriage 200 and an inlet nozzle assembly 201 that are each pivotally connected to the bottom of the handle 104.

The inlet nozzle assembly 201 comprises a lower nozzle shell 202 and an upper nozzle shell 204 that are joined together to form the inlet nozzle 114. The lower nozzle shell 202 includes the inlet 206 through which air enters the vacuum cleaner. A brushroll 208 is mounted to rotate within the inlet nozzle assembly 201, with the bristles of the brushroll 208 extending through the inlet 206 to contact and agitate the surface being cleaned. The brushroll 208 may be powered by a dedicated motor (not shown), as known in the art, but in a more preferred embodiment, the brushroll 208 is powered by a shaft 210 extending from the suction motor 328, by way of an intermediate belt 212 or gears.

The upper and lower nozzle shells 204, 202 join together to form a left arm 214 in the left side region 116 and a right arm 216 in the right side region 118. The left and right arms 214, 216 extend backwards from the inlet nozzle 114 to connect to the handle 104. The end of each arm 214, 216 includes a nozzle mounting boss 218. The nozzle mounting bosses 218 connect with other parts to form a pivoting connection between the nozzle assembly 201 and the handle 104, such as described below. The nozzle mounting bosses 218 may be formed as part of either or both of the upper and lower nozzle shells 204, 202, or a separate part that is connected to the nozzle assembly 201. The left and right arms 214, 216 may provide a belt tunnel 222 on one side to enclose the drive belt 212, and a base air passage 224 on the other side to fluidly connect the inlet nozzle 114 to a corresponding air passage 324 (see, e.g., FIG. 3) inside the handle 104. In this case, the nozzle mounting bosses 218 may comprise respective openings to pass suction air flow or a belt drive shaft 210.

The exemplary carriage 200 preferably is the primary structure for supporting the weight of the vacuum cleaner 100 on the surface being cleaned. The carriage 200 comprises a frame 226 to which one or more floor-contacting supports are connected. For example, the frame 226 has two rear support wheels 124 located behind the pivot axis 106, and two front support wheels 228 located in front of the pivot axis 106. The wheels 124, 228 may be mounted by respective axles, and may include bushings, bearings or other rotating supports, as desired. It will be appreciated that either of the foregoing pairs of wheels may be replaced by a single wheel, one or more skids, or groups of more than two wheels.

The handle 104 is pivotally mounted to the carriage 200 so that the handle 104 can be moved between an upright storage position and an inclined operating position. The inclined operating position may be a single, discrete orientation relative to the carriage 200, but, more preferably, encompasses a continuous range of orientations to accommodate the natural inclination to continuously raise and lower the handle 104 as the vacuum cleaner is moved back and forth over the floor.

In the shown embodiment, the handle 104 is pivotally mounted to the carriage by a left mounting ring 230 and a right mounting ring 232 that are disposed on opposite sides of the frame 226. The left and right mounting rings 230, 232 have an opening 233 between them to receive the bottom of the handle 104, and are joined by one or more rigid cross-members 236.

Figure 3A:
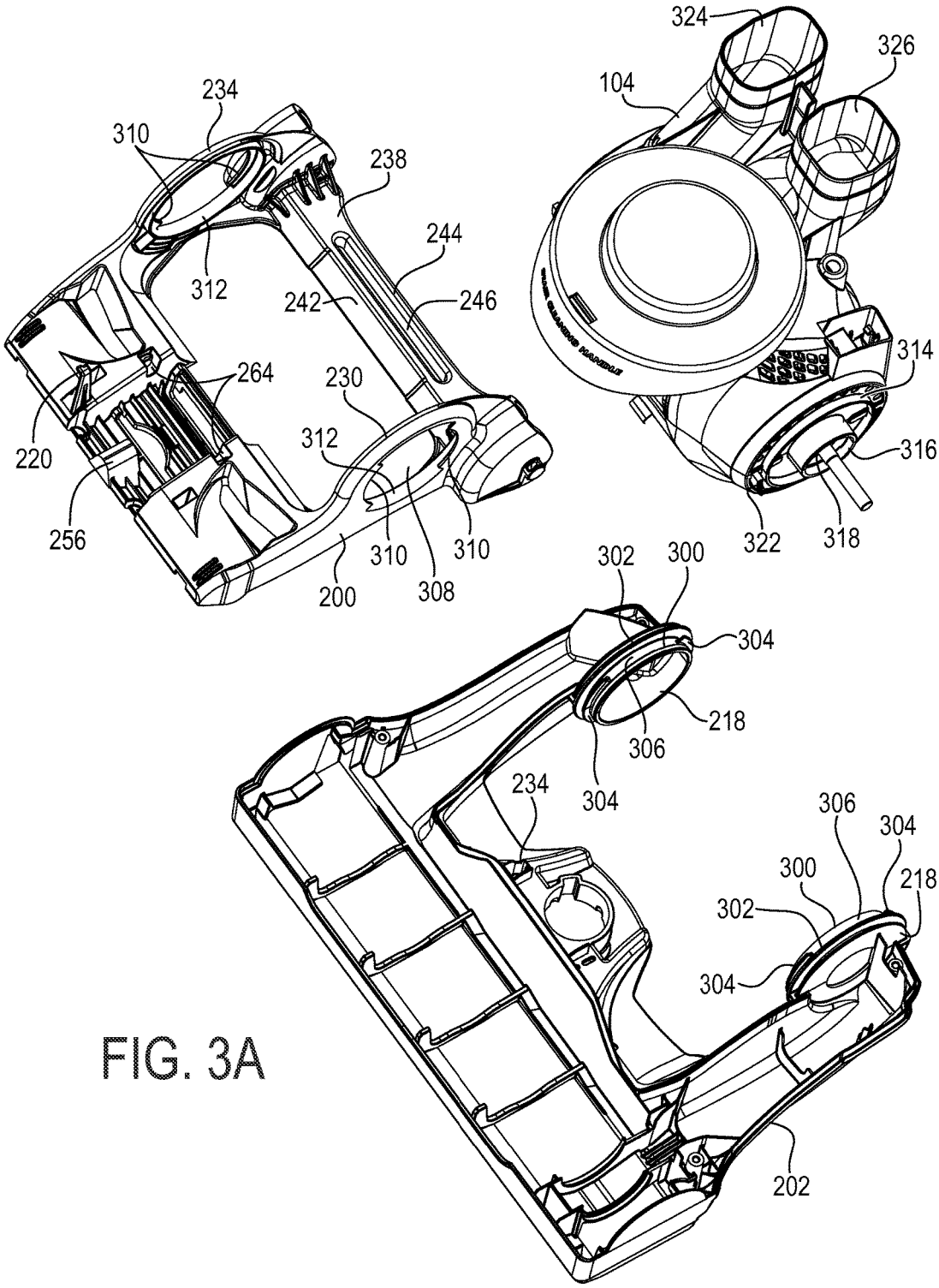
FIG. 3A is an exploded isometric view of parts forming an exemplary embodiment of a mounting arrangement to pivotally connect an upright vacuum cleaner base and handle.
Figure 3B:
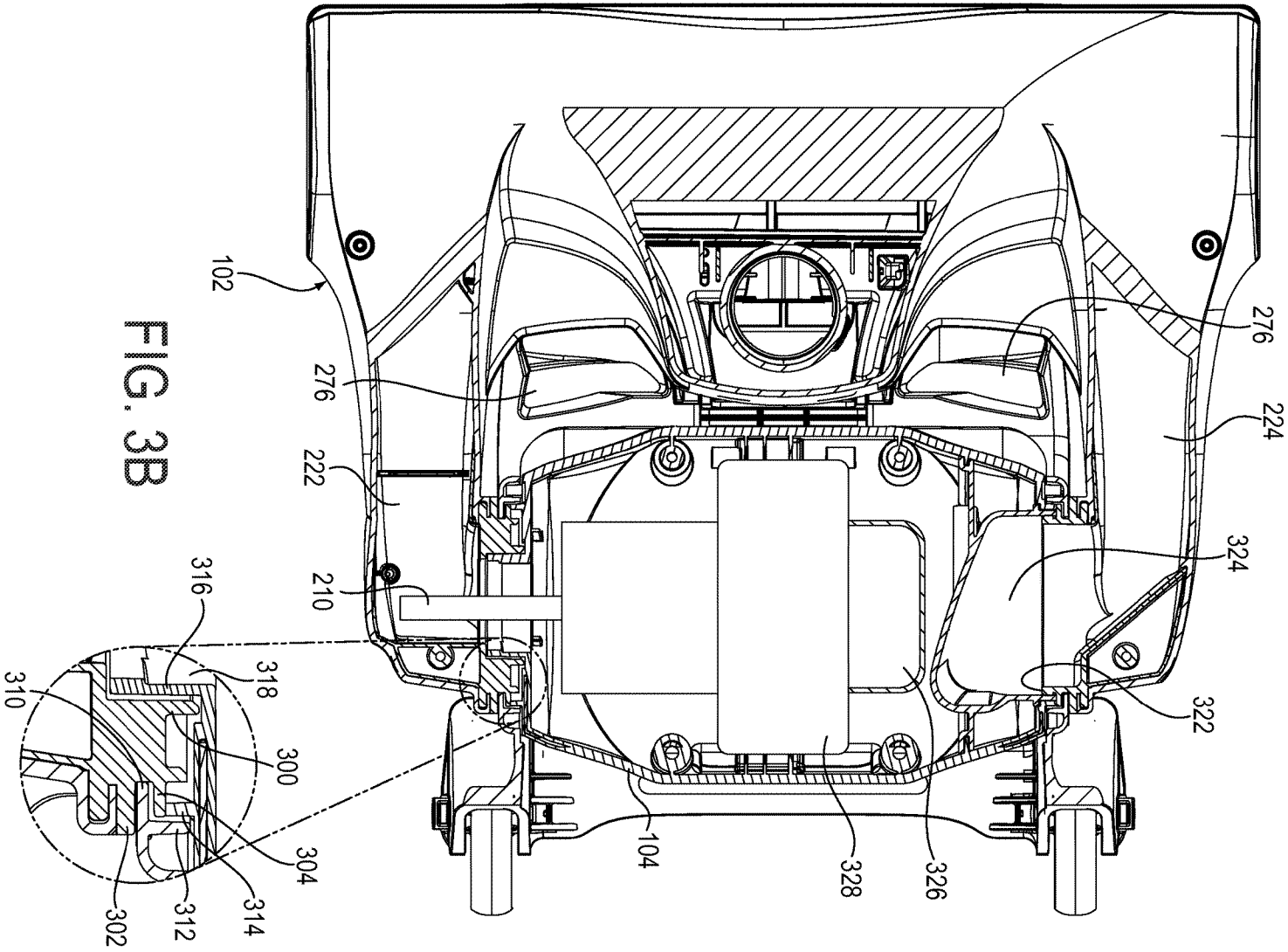
FIG. 3B is a cross-sectional top view of the base and handle of the vacuum cleaner of FIG. 1, shown divided at the pivot that joins the base and handle.

FIGS. 3A and 3B show an exemplary pivotal mounting arrangement to connect the nozzle assembly 201, carriage 200 and handle 104. In this example, the nozzle mounting bosses 218 interlock with the mounting rings 230, 232 to join the nozzle assembly 201 and carriage 200 in a pivoting connection. Any number of interlocking mechanisms may be used for this connection. In this example, each nozzle mounting boss 218 includes a shaft 300 from which a first flange 302 and a second flange 304 extend. The shaft 300 may be hollow to accommodate a belt drive shaft 210 or provide air communication. The first flange 302 may comprise a continuous circular shape, whereas the second flange 304 has one or more gaps 306.

Each mounting ring 230 includes a generally circular opening 308 into which the shaft 300 fits. The opening 308 has inward flanges 310 that are sized to pass through the gaps 306 as the shaft 300 is moved into the opening 308. Once the shaft 300 is fully installed, the nozzle mounting boss 218 is rotated relative to the carriage 200 (e.g., by rotating the entire lower nozzle shell 202) to position the inward flanges between the first and second flanges 302, 304. In this position, the mounting rings 230, 232 are captured in place on the nozzle mounting boss 218 with respect to axial movement along the shaft 300, but free to rotate around the nozzle mounting boss 218 about a rotation axis that is parallel with, and may be collinear with, the handle rotation axis 106.

The mounting rings 230, 232 each include a circular carriage mounting boss 312, which may form the outer perimeter of the opening 308, such as shown, or be spaced from the opening 308. The carriage mounting boss 312 engages a circular handle mounting boss 314 that extends laterally from the side of the handle 104. The carriage mounting boss 312 and handle mounting boss 314 together form a bearing surface to transfer the weight of the handle 104 to the carriage 200. To do so, the carriage mounting boss 312 may either surround (as shown) or be surrounded by the handle mounting boss 314. Low friction coatings, bearings or a bushing material may be used to reduce wear and resistance between these parts, but the use of simply conventional plastic materials is expected to provide a suitable rotating connection. The carriage mounting boss 312 and handle mounting boss 314 define the handle rotation axis 216. In a preferred embodiment, the handle rotation axis is collinear with a rotation axis of the belt drive shaft 210. If desired, one or more travel stops 322 may be provided on the carriage 200 or handle 104 to prevent relative rotation between the carriage 200 and handle 104 beyond a predetermined point. The shown travel stop 322 (which may be provided on both sides of the handle 104) fits into a groove on the inner wall of the mounting ring 230, 232 and the groove is sized to permit a limited range of relative rotation. The outer surface of the mounting ring 230, 232 may be shaped to match the contour of the adjacent portions of the handle 104 to provide a smooth aesthetic appearance.

The nozzle assembly 201, carriage 200 and handle 104 of FIGS. 3A and 3B are assembled in the following manner. First, the carriage 200 is attached to the handle 104 by placing the mounting rings 230, 232 and their respective carriage mounting bosses 312 over the corresponding handle mounting bosses 314. If the carriage 200 is made as a unitary part, it may be necessary to slightly deform the carriage 200 to accomplish this step. This can be avoided by making one or both mounting rings 230, 232 as removable parts, but this will increase the complexity of the device. Next, the lower nozzle shell 202 is positioned with the nozzle mounting bosses 218 on either side of the mounting rings 230, 232, and rotated to orient the gaps 306 in the second flanges 304 with the inward flanges 310 in the mounting ring openings 308. At this point, the lower nozzle shell arms 214, 216 can be pressed towards one another to move the nozzle mounting bosses 218 into place within the mounting rings 230, 232, and the nozzle assembly 201 is rotated to lock the parts together. When fully assembled, the nozzle assembly 201 surrounds both sides of both the carriage 200 and the handle 104 to hold the parts together. In addition, the second flanges 304 and inward flanges 310 preferably are positioned to lock together, as described above, when the nozzle assembly 201 is oriented on the carriage 200 in any normal use position. A hook 220 on the carriage 200 may be provided to engage a corresponding opening 234 on the nozzle assembly 201 to prevent the nozzle assembly 201 and carriage 200 from returning to a position in which they may be unlocked from one another.

It will be appreciated that alternative embodiments may use other arrangements to mount the nozzle assembly 201 and carriage 200 to the handle 104. For example, the parts may be assembled using conventional mounting pins or bearing shafts. As another example, the arrangement of the parts may be reversed, with the mounting rings 230, 232 located outward of the nozzle assembly mounting bosses 218. Other variations and modifications will be apparent to persons of ordinary skill in the art in view of the present disclosure.

On the left side of the exemplary embodiment, the belt drive shaft 210 extends into the belt tunnel 222. The belt tunnel 222 may be openable to service the belt 212. For example, the lower and upper nozzle shells 202, 204 may be connected by readily-accessed service screws 278 that can be removed to access the belt 212, or a separate removable panel may be provided on or between the shells 202, 204. The nozzle mounting boss shaft 300 may include an inner boss 316 that closely surrounds a tunnel 318 through which the belt drive shaft 210 passes, to help prevent the egress of motor debris (e.g., carbon dust).

On the right side, the base air passage 224 turns inwards and fluidly connects to a first handle passage 324 located inside the handle 104. The nozzle mounting boss shaft 300 on this side may have a relatively close tolerance to the inside of the handle mounting boss 314 to help prevent air leaks at this joint. Such tolerance may be provided simply by sizing the entire shaft to fit closely within the handle mounting boss 314, or by adding an outward flange 322 that extends towards the handle mounting boss 314, such as shown in FIG. 3B. If desired, one or more seals, such as felt pads or rubber skirts, may be added to the joint to further reduce air leaks. The first handle passage 324 turns upwards to lead to a dirt collection device 126. A second handle passage 326 is provided to connect the outlet of the dirt collection device 126 to the inlet of the suction motor 328. This so-called "clean air" system removes the majority of the dirt from the air before the air enters the suction motor 328, and the air leaving the suction motor 328 is vented to the atmosphere either directly or through a post-motor filter. In an alternative embodiment, the system may be a "dirty air" system in which the first handle passage 324 leads directly to the suction motor 328, and the second handle passage 326 leads from the outlet of the suction motor 328 to the inlet of the dirt collection device 126.

It is often desirable to store an upright vacuum cleaner handle in the upright position, such as when the cleaner is not in use or when it is being used with an accessory cleaning hose. To this end, the vacuum cleaner 100 may include a storage lock that prevents the handle 104 from pivoting backwards relative to the base 102 when it is unattended. Conventional storage locks typically comprise a foot-operated hook on the base, and a corresponding slot on the handle into which the hook fits to prevent handle rotation. Such devices require a separate foot-pedal to actuate the hook and a spring to bias the hook into the engaged position. This assembly can add unwanted cost to the device, must be robustly made to withstand the full weight of the operator (and thus heavy), and is subject to breakage. It also can be difficult to assemble the parts, as the spring often must be compressed during assembly. Furthermore, the area of the base 102 to which the foot-pedal is connected also may need to be reinforced to hold the pedal and resist the spring force, and support the user's weight when the pedal is activated. Another problem with conventional foot-pedals is that they are often mistaken for a power button (and vice-versa), particularly by operators who are unfamiliar with the device or unable to see the markings on the pedals, which leads to annoyance and dissatisfaction with the product. Other storage locks comprises a spring-loaded catch that may be released by overcoming the spring force. Such devices use a movable sliding or pivoting catch, along with a separate spring that biases the catch into place. The small surface area of the catch can require relatively strong local reinforcements to the vacuum cleaner structure to resist point loads, and the separate spring adds cost and complexity. Spring-loaded storage locks also may not be suitable for relatively heavy cleaners, because the weight of the cleaner may accidentally act to release the lock. While the storage locks described above may be used in some embodiments, a more preferred embodiment does away with a separate storage lock assembly and instead uses an integral storage lock system.

An example of an integral storage lock system is illustrated in the exploded view of FIG. 2 and the cross-sectional side views of 4A-4C. The exemplary storage lock assembly includes a resiliently-deformable crossbeam 238 and a protrusion 400. The crossbeam 238 preferably is located on the carriage 200, but may be elsewhere on the base 102, such as on the nozzle assembly 201. In the shown embodiment, the crossbeam 238 extends across the opening 233, and is connected at each end to one side of the frame 226. The crossbeam 238 preferably is located behind the handle pivot axis 106, but may be below or in front of the handle pivot axis 106 in other embodiments.

Figure 4A:
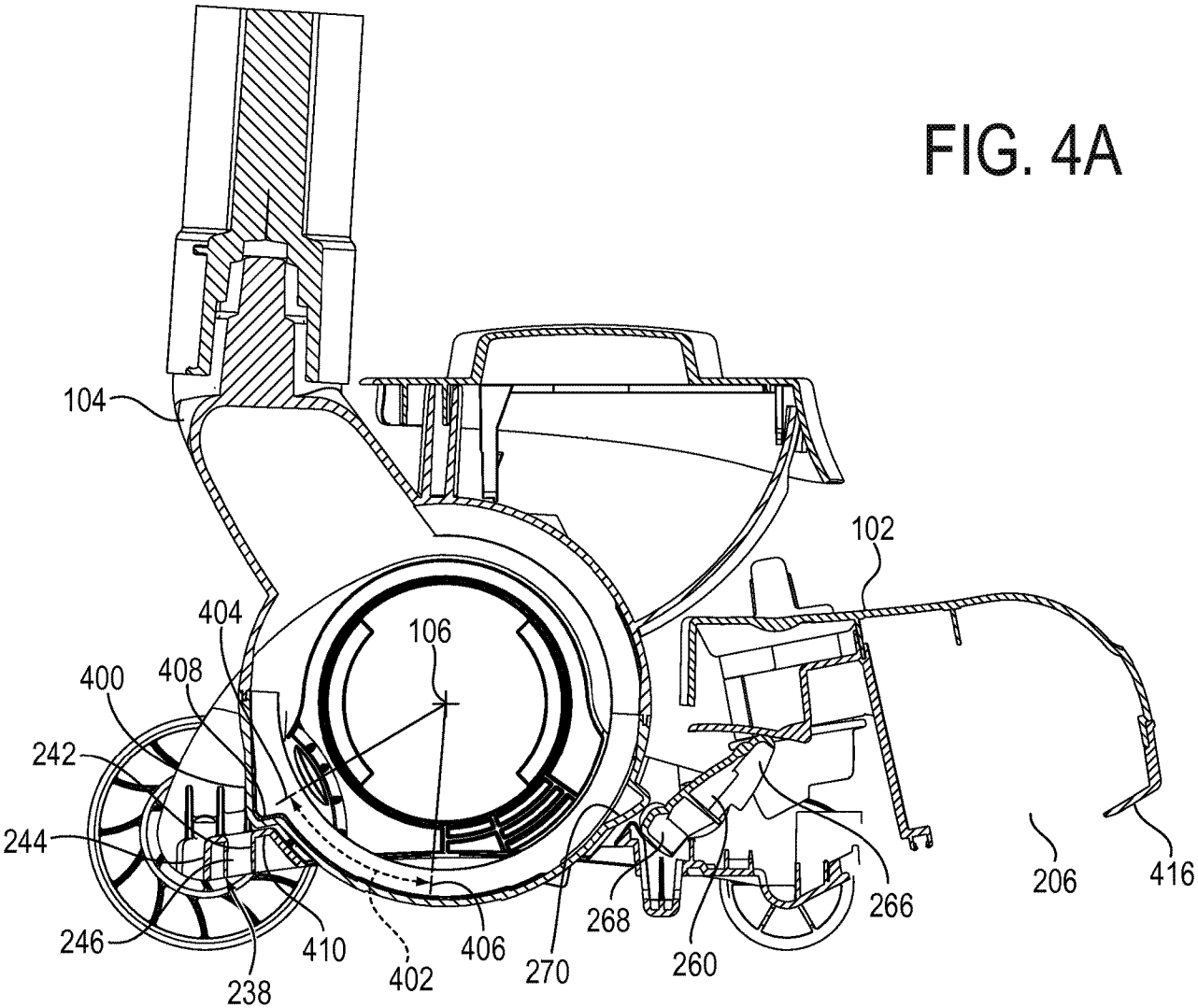
FIGS. 4A-4C are cross-sectional side views of the vacuum cleaner of FIG. 1, as seen at the longitudinal centerline of the device, showing the handle in three different positions relative to the base.

The protrusion 400 comprises an extension of the handle 104, and may be a separate attached part or molded integrally with the handle's housing. In the shown embodiment, the protrusion 400 is a wedge-shaped radial extension of the housing, but other shapes may be used. The protrusion 400 rotates with the handle 104, and moves through an arc of travel 402. The arc of travel 402 is centered on the handle pivot axis 106, and extends between an upright end 404 (where the protrusion 400 is located when the handle 104 is in the upright position with respect to the base 102), and a reclined end 406 (where the protrusion 400 is located when the handle 104 is at its lowest inclination with respect to the base 102). The arc of travel 402 may comprise any suitable range of movement, such as a range of approximately 20 to 120 degrees, as measured around the handle pivot axis 106. The crossbeam 238 is positioned to intersect the arc of travel 402 near the upright end 404, to thereby contact and hold the protrusion 400 with the handle 104 in the upright position, such as shown in FIG. 4A. In this position, shown in FIG. 4A, a first side 408 of the protrusion 400 contacts a first side 410 of the crossbeam 238.

Figure 4B:
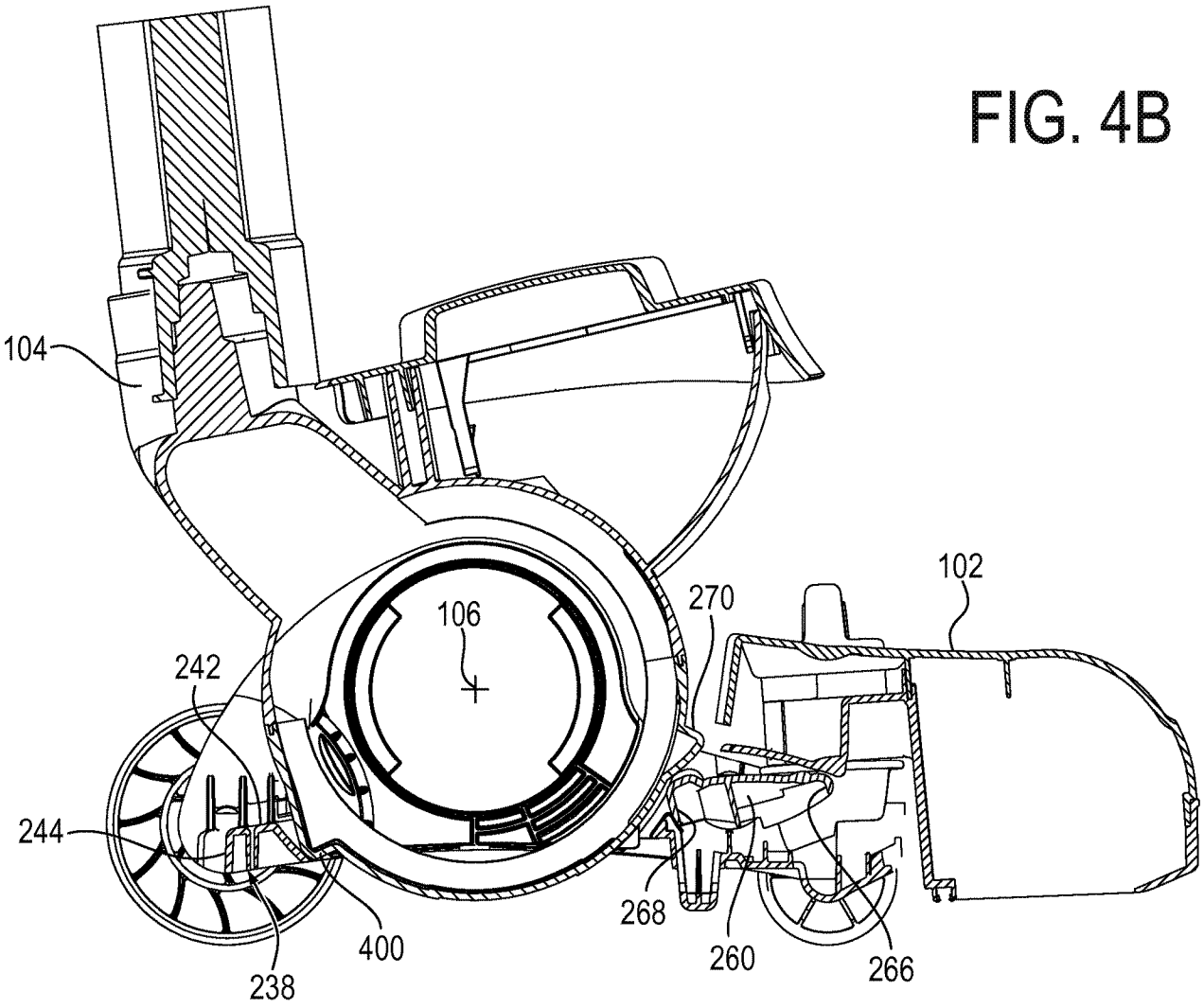

The handle 104 is reclined from the storage position by applying an unlocking force to move the protrusion 400 past the crossbeam 238. During this movement, the protrusion 400 presses against and temporarily deforms the crossbeam 238, such as shown in FIG. 4B. The unlocking force is generated by applying opposite rotation forces to the handle 104 and the base 102. These forces may be generated in a variety of ways, but it is expected that the unlocking force will typically be generated by pulling back on the handle 104 with a hand, while simultaneously pressing downward with a foot on the front of the base 102. A graphic instruction image 240, such as a representation of a foot or shoe, may be provided on the top of the base 102 to guide the operator on how or where to generate the necessary unlocking force. This instruction image 240 may be located at a region of the base 102 that is particularly suited—such as in relation to the strength or shape of the region—to manage the directed force.

Figure 4C:
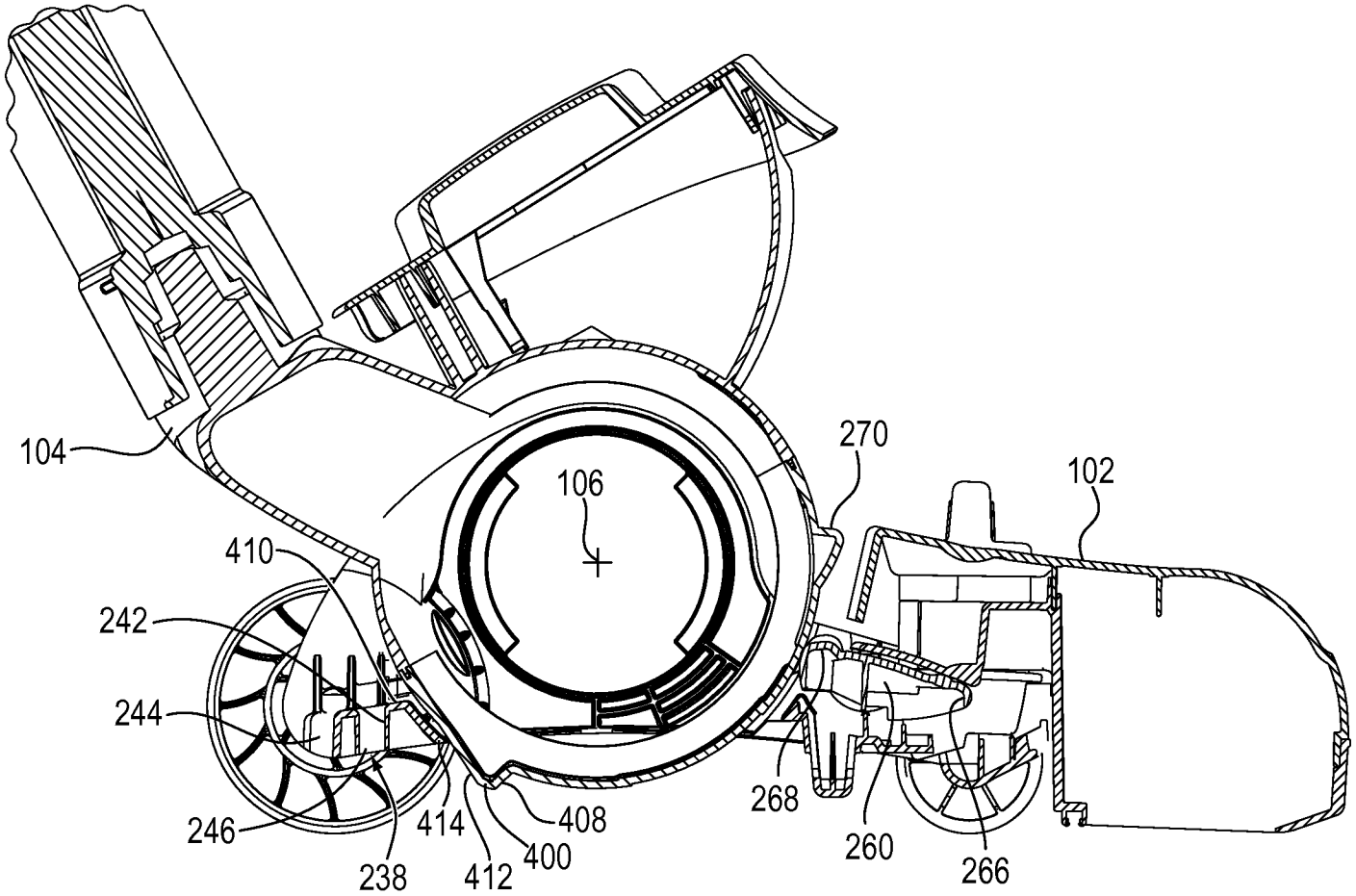

Once the protrusion 400 clears the crossbeam 238, such as shown in FIG. 4C, the handle 104 is freely pivotable with respect to the base 102 throughout the remainder of the protrusion's arc of travel 402. The freely-rotatable range that makes up the reclined position may comprise a range of approximately 30 to 100 degrees from the reclined position towards the upright position without contact between the protrusion 400 and the crossbeam 238, but other ranges may be used in other embodiments.

The handle 104 is returned to the upright position by moving the handle 104 forward until a second side 412 of the protrusion 400 contacts a second side 414 of the crossbeam 238, and then applying a locking force to cause the protrusion 400 to deform the crossbeam 238. The locking force is generated by applying opposite rotation forces to the handle 104 and the base 102, but in this case it may only be necessary to push forward on the handle 104 with a hand, as the necessary force on the base 102 can be applied by contact with the floor. If the required locking force is great enough, it may be necessary to tip the vacuum cleaner 100 forward onto the front of the base 102, and perhaps even to push down on the handle 104 with the vacuum cleaner leaned forward, to generate the necessary force.

The unlocking and locking forces can be selected and adjusted by modifying the shapes and elastic moduli of the protrusion 400 and crossbeam 238. For example, forming the one or both of the contacting sides of the protrusion 400 and crossbeam 238 as a gradual slope can reduce the apparent required locking or unlocking force, but may allow some relative movement even when the parts are locked together. Forming one of both of the contacting sides as a steep ramp would increase the apparent locking or unlocking force, but potentially provide a more distinct lock with less slack. In the shown exemplary embodiment, the first side of the protrusion 400 and the first side 410 of the crossbeam 238 abut one another on a plane that has a relatively large angle relative to the arc of travel 402, as shown in FIG. 4A, whereas the second side 412 of the protrusion 400 abuts the second side 414 of the crossbeam 238 at an angle that is relatively small relative to the arc of travel 402, as shown in FIG. 4C. It will be apparent, from these figures that a force applied along the arc of travel 402 to move the handle 104 from the upright position will generate a relatively low vector force to deform the crossbeam 238, whereas a force applied along the arc of travel 402 to move the handle from the reclined position back up to the upright position will generate a much larger vector force to deform the crossbeam 238. Stated differently, the parts are shaped to require a larger unlocking force than the locking force.

The length and cross-sectional shape of the crossbeam 238 also affect its rigidity and thus the amount of force necessary to unlock and lock the handle 104. In the shown embodiment, the crossbeam 238 extends laterally across the of the opening 233, and may provide structural support to hold the rear wheels 124 in proper alignment. To provide the necessary stiffness as a structural element, while still being resilient enough to act as a deformable lock, the crossbeam 238 may be formed as a flexible spar 242 and a relatively rigid spar 244 that are assembled together or integrally formed as a single structure that spans the opening 233. In this case, the crossbeam 238 is a molded plastic part (which preferably is integrally molded with the frame 226, but may be a separate part), and the flexible spar 242 and rigid spar 244 are formed by dividing the crossbeam 238 with a laterally-elongated slot 246. The slot 246 may be an open slot that passes all the way through the crossbeam 238 (as shown), a closed slot that does not pass all the way through the crossbeam 238, or a combination of slot structures. Multiple slots 246 also may be provided to further modify the stiffness of the crossbeam 238. In the shown embodiment, the single open slot 246 reduces the stiffness of the crossbeam 238, so that the flexible spar 242 flexes into the space within the slot 246 to permit the protrusion 400 to move between the storage and upright positions, and the rigid spar 244 does not flex any appreciable amount during locking and unlocking. An example of this arrangement is illustrated in FIG. 4B. The length of the slot 246 and flexible spar 242 may be modified to adjust the stiffness of the flexible spar 242. In the present embedment, the slot 246 and flexible spar 242 extend only a portion of the distance across the opening 233. If greater or lesser locking forces are desired, the slot 246 may be shortened or elongated, respectively. Changing the thickness or cross-sectional shape of the flexible and rigid spars 242, 244 also will affect the stiffness, as will be appreciated upon review of the present specification.

The location and size of the protrusion 400 also can affect the locking and unlocking forces. In the shown embodiment, the protrusion 400 is located midway between the ends of the crossbeam 238, and halfway across the opening 233, on the centerline of the handle 104. This places the protrusion 400 at the most flexible part of the crossbeam 238. In other embodiments, other locations may be used. The protrusion 400 may be relatively large, to distribute the loading force to reduce point loads that could cause fatigue or excessive wear. For example, the protrusion may be at least about 1 inch wide or wider, to distribute the load to a correspondingly-sized portion of the crossbeam 238. In addition, the protrusion 400 itself may be made with some resilience such that it also deforms to permit locking and unlocking.

While these arrangements are preferred, it will be appreciated that variations may be made while providing essentially the same function and results. For example, the crossbeam 238 and protrusion 400 may be interposed in other embodiments, with the protrusion being on the base 102, and the crossbeam 238 being on the handle 104. As another example, the crossbeam 238 may be a cantilevered beam that extends part-way across the opening 233.

The exemplary embodiment and variations thereof are expected to provide benefits over conventional handle lock arrangements. The crossbeam 238 and protrusion 400 are readily formed as parts of conventional plastic molds, and require no moving parts or added springs, and therefore may not add any substantial costs (or any costs at all) to the product. The use of a flexible crossbeam 238 also eliminates the need to have a release pedal and its associated hardware and mounting supports, which may significantly reduce weight. In addition, the locking and unlocking forces may be borne by the relatively large areas of the crossbeam 238 and protrusion 400, as opposed to the small hooks and slots used in conventional devices, which distributes the locking and unlocking forces across a large area and allows the parts to be made from relatively light and thin-walled materials that do not need to resist the point loads generated by conventional locks. The use of a crossbeam 238 that completely spans the distance between the handle pivot locations also allows a relatively large deflection distance without generating local stresses that could fatigue or wear away the parts. Also, the use of a slot 246 to form a flexible spar 242 and a rigid spar 244 and allows the crossbeam 238 to act both as a rigid structural frame element and as a deformable lock mechanism, which opens up the possibility of locating the locking mechanism behind the pivot axis 106 without having to add any significant extra bulk to the device. Other features and benefits will be apparent from the present disclosure and practice of the invention.

Referring back to FIG. 2, the base also may include a height-adjusting mechanism that raises and lowers the downward-facing inlet 206 relative to the surface being cleaned. In the shown embodiment, the height-adjusting mechanism comprises a knob 248 that is rotatably mounted to a boss 250 that extends from the lower nozzle shell 202. The knob 248 has a bearing surface 252 that abuts a bottom side of the boss 250 and holds the boss 250 in the vertical direction. Below the bearing surface 252 is a circular cam 254, which may be a smooth circular ramp or have a series of discrete steps located at different distances from the bearing surface 252. When the inlet nozzle assembly 201 and carriage 200 are mounted to the handle 104, the circular cam 254 abuts a post 256 on the carriage 200. Rotating the knob 248 slides the circular cam 254 along the post 256, which causes the circular cam 254 to act as a wedge to raise or lower the inlet nozzle assembly 201 relative to the carriage 200. The general principal of operation of such a device is illustrated, for example, in U.S. Pat. No. 7,246,407, which is incorporated herein by reference.

The knob 248 may be accessed directly, or through a corresponding access hole 258 through a corresponding boss 250' formed on the upper nozzle shell 204. When the inlet nozzle assembly 201 is assembled, the bosses 250, 250' form a single structure that extends backwards from the inlet nozzle 114, and the top of the knob 248 is accessed from above the inlet nozzle assembly 201, as shown in FIG. 1. Height setting indicators (not shown) may be provided on the upper nozzle shell 204 surrounding the access hole 258 to indicate the selected height setting.

It will be appreciated that changes may be made to the foregoing height adjustment mechanism, and variations and modifications will be apparent to persons of ordinary skill in the art in view of the present disclosure. It will also be appreciated that other kinds of height adjusting mechanism may be used on other embodiments. For example, the knob and its circular cam may be replaced by a sliding linear cam, such as shown in U.S. Patent Publication No. 2006/0070209, or a rotating wheel, such as shown in U.S. Pat. No. 7,895,707.

Embodiments also may include features to disengage the brushroll 208 when the handle 104 is moved to the upright position. This may be desirable to prevent the brushroll 208 from continuing to rotate in one place on a carpet or other floor surface when the handle 104 is upright, but the vacuum cleaner 100 remains on (e.g., during above-floor cleaning with an accessory hose). Where the brushroll 208 has a dedicated drive motor, a microswitch or other device may be provided to turn off the dedicated motor upon placing the handle 104 into the upright position. Such microswitches and brushroll shut-off circuits are known in the art and need not be described here. In embodiments in which the brushroll 208 is driven by the suction motor 328, such as in the shown example, power from the suction motor 328 to the brushroll 208 can be terminated by disengaging the drive belt 212 by any of a variety of mechanisms. Known devices include, for example, belt tensioner pulleys that are slacked to release belt tension, idler pulleys onto which the belt 212 is slid, and belt lifters that lift the belt 212 out of engagement with the drive shaft 210. Such devices are conventional and need not be described here. Alternatively, the brushroll 208 can continue to be powered, but simply lifted out of contact with the underlying floor by a nozzle-lifting mechanism.

The illustrated exemplary embodiment includes a nozzle-lifting mechanism in the form of a liftoff lever 260. The liftoff lever 260 is mounted on the carriage 200 by two pivot bosses 262 on the liftoff lever 260 that fit into corresponding pivot grooves 264 on the carriage 200. When so mounted, the liftoff lever 260 is free to rock between a first position in which a front end 266 of the liftoff lever 260 is lowered and a back end 268 of the liftoff lever 260 is raised, and a second position in which the front end 266 of the liftoff lever 260 is raised and the back end 268 of the liftoff lever 260 is lowered.

The front end 266 is located under the inlet nozzle assembly 201. For example, the shown liftoff lever's front end 266 may be shaped to fit immediately behind the height adjustment knob's bearing surface 252. When the liftoff lever 260 is in the first position, the front end 266 is lowered and clear of the inlet nozzle assembly 201, which permits the inlet nozzle assembly 201 to lower and raise freely as the operator adjusts the height adjustment knob 248. When the liftoff lever 260 is placed in the second position, the front end 266 presses upwards on the bottom of the inlet nozzle assembly 201 and lifts it high enough for the brushroll 208 to clear the underlying floor. In this latter position, the inlet nozzle assembly 201 may be above the highest setting provided by the height adjustment knob 248. In other embodiments, the liftoff lever 260 may be used even if a height adjustment mechanism is not provided.

The liftoff lever 260 may be operated by a separate control such as a foot pedal, but more preferably is operated by the handle 104 as the handle 104 is moved into the upright position. For example, the handle 104 may include one or more protrusions 270 that rotate with the handle 104. As the handle 104 is rotated to the upright position, the protrusions 270 eventually contact the back end 268 of the liftoff lever 260 to move the liftoff lever 260 into the second position to raise the inlet nozzle assembly 201. Other engaging mechanisms, such as slots in the handle 104 and corresponding ribs or lobes extending from the liftoff lever 260, may be used in other embodiments.

The operation of the exemplary liftoff lever 260 is illustrated in the cross-section views of FIGS. 4A-4C. FIG. 4A shows the liftoff lever 260 in the second position, as it is positioned when the handle 104 is upright. FIGS. 4B and 4C show the liftoff lever 260 transitioning to and entering the first position as the handle 104 is leaned backwards. Motion of the liftoff lever 260 is caused by contact between the protrusions 270 and the back end 268 of the liftoff lever 260.

The foregoing exemplary embodiment and variations thereof are expected to provide a simple, inexpensive, and lightweight liftoff mechanism having a single moving part interposed between the handle 104 and the base 102. However, other activation mechanisms may be used in other embodiments. For example, the liftoff mechanism may be connected to and driven by a linkage that is drivingly connected to the handle 104, or it may be a manually-operated mechanism that is operated by a foot pedal or a similar manual control.

Various other features may be provided in the base 102. For example, a spring 272 may be provided to pull the inlet nozzle assembly 201 towards the carriage 200, to prevent the inlet nozzle assembly 201 from freely lifting above the height established by the height adjustment knob 248. The inlet nozzle assembly 201 also may include a belt cover (not shown) that encloses the belt 212 and closes off the left arm 214 to inhibit dirt and air entering the inlet 206 from fouling the belt 212. Also, a flexible wiper 274, bristles, or other cleaning members may be connected to the base 102 to contact the floor to assist with cleaning. Other variations and modifications will be apparent to persons of ordinary skill in the art in view of the present disclosure.

Figure 5:
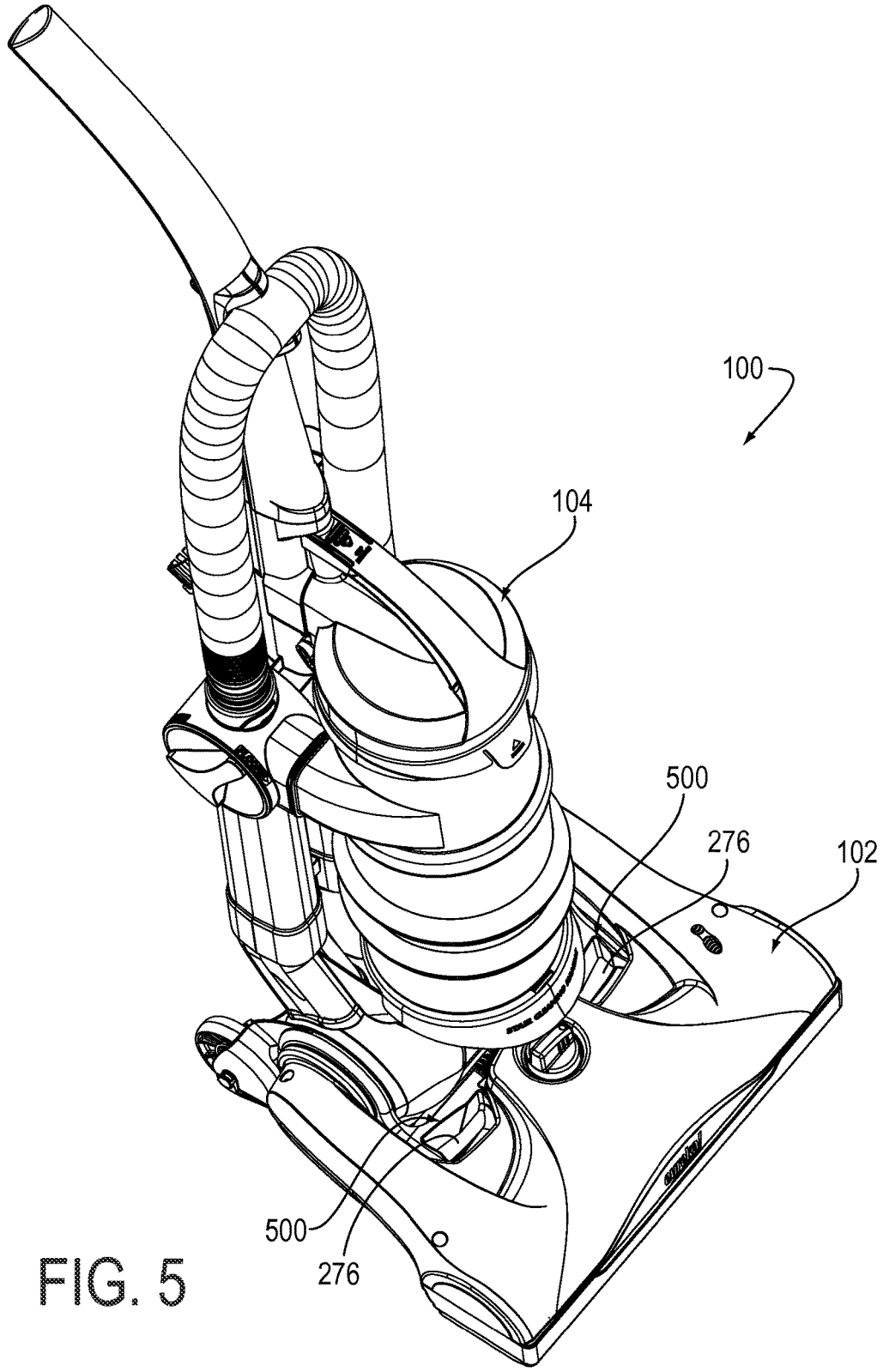
FIG. 5 is a detailed top isometric view of the base and lower portion of the handle of the vacuum cleaner of FIG. 1.
Figure 6:
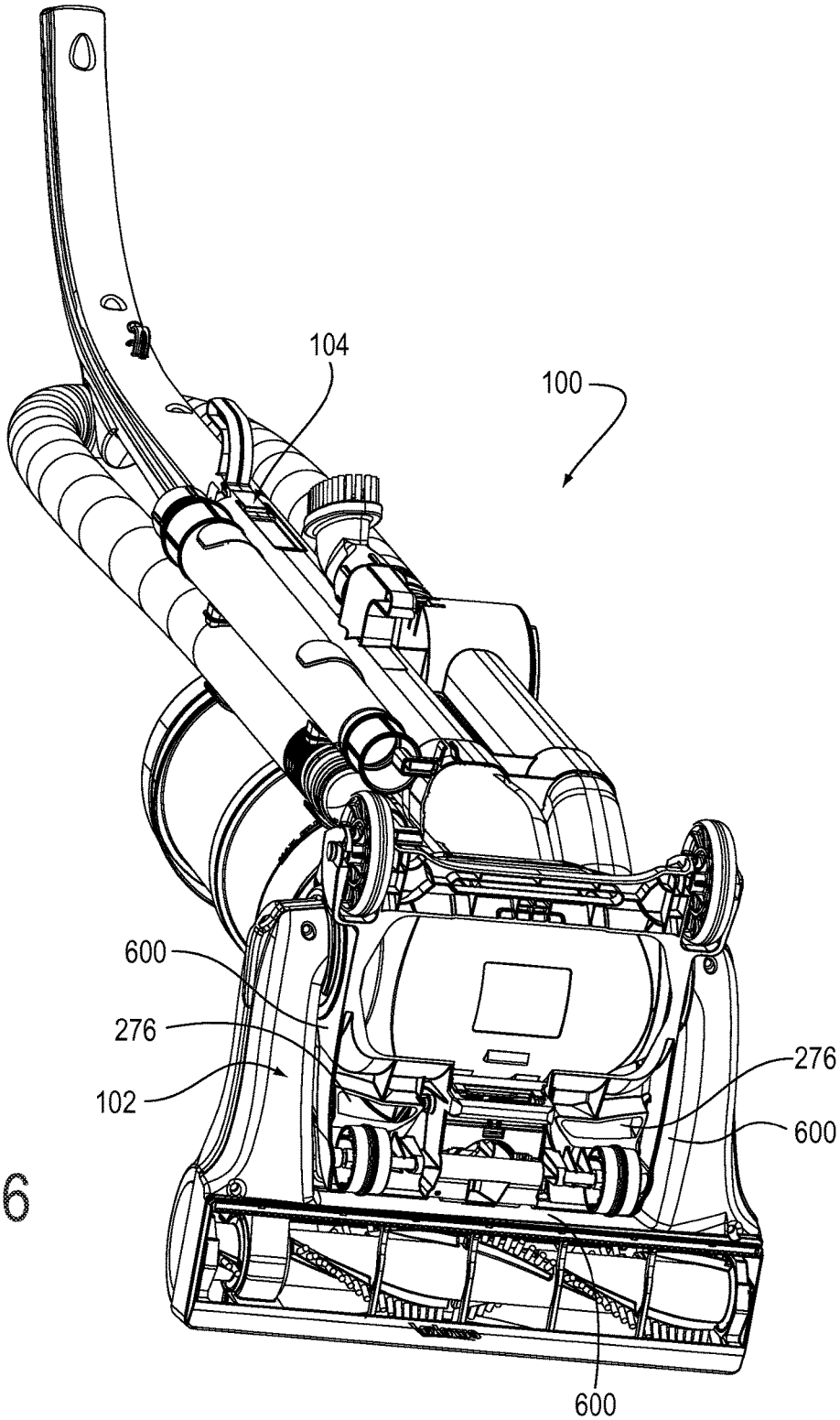
FIG. 6 is a detailed bottom isometric view of the base and lower portion of the handle of the vacuum cleaner of FIG. 1.

As shown in FIGS. 5 and 6, the arrangement of the exemplary inlet nozzle assembly 201 and carriage 200 provides a unique and beneficial arrangement. As described above, the inlet nozzle assembly 201 and carriage are separately pivotally mounted to the handle 104. This allows the carriage 200 to hold the weight of the support wheels 124, 228, and the majority of the handle's weight is transmitted through the carriage 200 and to the floor via the left and right mounting rings 230, 232 and support wheels 124, 228. Thus, only the left and right mounting rings 230, 232 need to be designed as load-bearing members. By shifting the weight of the wheels 124, 228 and the weight-bearing duties to the carriage 200, the inlet nozzle assembly 201 can be made as a relatively lightweight structure with light-duty pivots to join it to the handle 104, and the height-adjusting mechanism does not need to bear as large a weight. This arrangement also facilitates the production of a variety of different products by simply replacing the nozzle assembly. For example, a range of vacuum cleaners can be produced having: different widths or types of floor agitator (or with no brushroll or other agitator); different (or no) height-adjustment mechanisms, different brushroll drive systems (e.g., the addition of a dedicated brushroll motor); and so on. Such modifications can be made at relatively little cost simply by replacing the inlet nozzle assembly 201, and the carriage 200 and handle 104 need not be redesigned or separately made for each individual product in the product line.

The separated inlet nozzle assembly 201 and carriage 200 arrangement also may allow a simpler inlet nozzle assembly construction that does away with complex molded parts having numerous cavities as found in conventional devices. As shown in FIG. 2, the lower nozzle shell 202 comprises a simple structure having a single continuous C-shaped channel, and the upper nozzle shell 204 is correspondingly-shaped. The assembled inlet nozzle assembly 201 may comprise only an inlet nozzle 114, left and right arms 214, 216 that extend backwards from the inlet nozzle 114 to the handle 104, and a height-adjustment mechanism boss 250, 250' that extends backwards from the inlet nozzle 114.

The remaining space between the inlet nozzle 114 and the handle 104 may be open, which can provide additional benefits. For example, providing an opening or openings through the inlet nozzle assembly 201 may permit the operator to view the carriage 200 to confirm its position relative to the inlet nozzle assembly 201 or view the floor below the carriage 200. In this case, there are two openings 500 (FIG. 5), with one being located on each side of the boss 250, 250', but other numbers of openings may be provided. For example, the boss 250, 250' may be moved to one side or removed to provide a single large opening.

The carriage 200 may have one or more openings 276 located below the open portions 500 of the inlet nozzle assembly 201. Further openings also may be provided by gaps 600 (FIG. 6) between the back of the inlet nozzle 114 and the inner edges of the left and right arms 214, 216 and the front and sides of the carriage 200. These openings 276 and gaps 600 act as vents to allow ambient air to enter the space below the inlet nozzle assembly 201 and carriage 200 and immediately behind the downwardly-facing inlet 206. This airflow may be useful to prevent the accumulation of a large low-pressure region under the center of the base 102 (which can lift loose carpets and the like at a location behind the inlet 206), and to allow air to pass more readily into the back edge of the inlet 206, which may enhance cleaning performance under some circumstances. The openings 276 also beneficially allow an operator to observe the condition of the underlying floor.

It has been discovered that embodiments such as those described herein can provide significantly enhanced operating characteristics on certain carpet surfaces, as compared to conventional upright vacuum cleaners. In particular, it has been found that vacuum cleaners constructed in a manner similar to that shown in FIG. 7 can require a very high operating force $F_1$ of to move the vacuum cleaner forward over very dense carpets that permit relatively little flow through the carpet fibers. In contrast, embodiments such as described herein in relation to FIGS. 1-6 can require a much lower operating force $F_1$ to move the vacuum cleaner on the same carpet, with little (and possibly no) degradation in cleaning performance.

The operating force $F_1$ is a measure of the effort it takes to move the vacuum cleaner. It may be measured according to ASTM International standard No. F1409-00 (Reapproved 2010), which measures the relative work necessary to move the operating vacuum cleaner forwards and backwards across a given surface. The data developed by this standard is reported in foot-pounds. In preliminary testing, it was found that embodiments similar to those described herein with respect to FIGS. 1-6 can obtain relative work measurements that are less than one-third of a competitive conventional vacuum cleaner, while still obtaining nearly the same cleaning performance. For example, one device obtained a relative work rating of about 50 foot-pounds, as compared to a conventional device that required over 175 foot-pounds to operate on the same carpet (in both cases, the vacuum cleaner was operated with the suction inlet at the maximum height setting on a carpet having relatively high and dense piles). It is expected that this benefit will be provided during operation on any relatively dense carpet.

The magnitude of the operating force $F_1$ has often been considered to be a function of various factors. One factor is the suction force pulling the base and carpet into close contact ("suction lock"), which causes friction and resists movement. Wheel rolling resistance and friction between the carpet and the lower base surface are also factors. Suction lock is exacerbated in dense carpets that inhibit airflow through the carpet fibers when the suction inlet is pressed against the carpet surface. One typical solution to excessive operating force $F_1$ is to raise the suction inlet well above the carpet using a height adjustment mechanism. However, not all vacuum cleaners have height adjusters, and even those that do may not extend far enough to place the suction inlet out of suction lock range (particularly when the front wheels sink deeply into the carpet). In all cases, when the suction inlet is raised well out of range of the carpet to mitigate suction lock, it can greatly reduce cleaning efficiency and lead to customer dissatisfaction. Another possible solution is to form the bottom of the base 702 with a large "skid" plate that rests on the carpet to help hold the suction inlet 714 at or near the top of the carpet surface, but such skid plates increase friction, can be costly (if made of metal), and simply may not work as desired. Still another solution is to provide excessively large side vents into the suction inlet to draw air from the sides to prevent suction lock. This solution also has the problem of reducing the concentration of airflow at the target surface and reducing cleaning performance. Furthermore, such vents will affect operation even when suction lock is not being experienced, such as during use on hard floors or low carpets, and it is usually desirable to not to make such vents excessively large.

Figure 7:
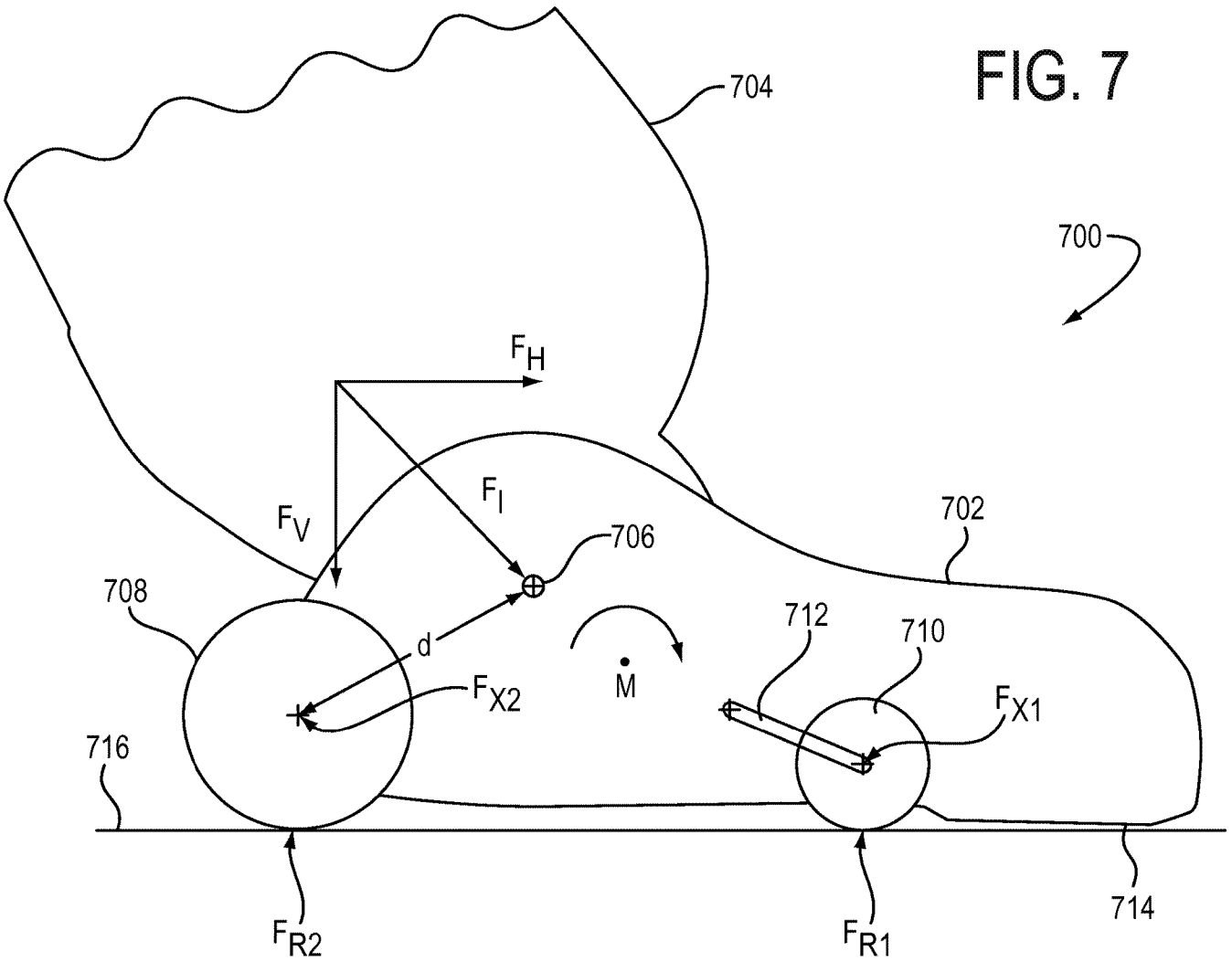
FIG. 7 is a schematic side view of a prior art upright vacuum cleaner.

It has been found that another factor influencing the generation of suction lock and high operating force in upright vacuum cleaners is the arrangement and construction of the base. As shown in FIG. 7, the typical base 702 comprises a unitary rigid structure that joins the front and rear wheels 710, 708, handle pivot 706 and suction inlet 714. The locations of the various elements are selected to provide certain benefits. For example, the rear wheels 716 are located behind the handle pivot axis 706 to provide stability necessary to keep the vacuum cleaner 700 from toppling when it is placed in the upright position for storage. If the handle pivot 706 is behind the rear wheels 708, a downward force applied during storage would cause the vacuum cleaner 700 to pitch backwards (locating the center of gravity of the handle 704 forward of the rear wheels 708 reduces this problem, but is not likely to prevent toppling upon the application of forces that might be applied in normal use and during storage). Locating the handle pivot 706 forward of the rear wheels 708 is also desirable to provide a stable platform for accessory tool cleaning operations, which are performed by pulling on and manipulating a hose attached to the handle 704. For similar reasons, it is desirable to place the front wheels 710 well forward of the pivot axis 706.

Despite providing the overall stability desirable for upright vacuum cleaners, the arrangement as shown in FIG. 7 has been found to cause significant suction lock and high operating force problems under some circumstances. As shown in FIG. 7, the operating force $F_1$ acts as a vector force oriented from the handgrip at the top of the handle 704 to the handle pivot 706. Thus, the operating force $F_1$ includes a downward vector component $F_V$ and a horizontal vector component $F_H$. The downward vector component $F_V$ is opposed by first and second restoring forces $F_{R1}$ and $F_{R2}$ applied vertically to the wheels 708, 710. The first and second restoring forces $F_{R1}$, $F_{R2}$ also include a component opposing the weight of the vacuum cleaner 700. Because the majority of the vacuum cleaner's weight rests on the rear wheels 708 (particularly with the handle 704 leaned back for use), the rear restoring force $F_{R2}$ is expected to be significantly higher than the front restoring force $F_{R1}$.

The horizontal vector component $F_H$ is the force that moves the vacuum cleaner 700 forward against resistance. A first resistance force $F_{X1}$ is generated by contact between the front wheel 710 and the underlying surface 716, and second resistance force $F_{X2}$ is generated by contact between the rear wheel 708 and the underlying surface 716. The resistance forces $F_{X1}$, $F_{X2}$ may include rolling resistance and basic friction components, both of which are proportional to weight. Thus, because the rear wheel 708 bears most of the vacuum cleaner's weight, the second resistance force $F_{X2}$ should be significantly higher than the first resistance force $F_{X1}$. Additional resistance forces opposing horizontal vector component $F_H$ may be created by suction lock, as described above, and by frictional contact between the base 702 and the surface 716. If a rotating brush is used, it may generate a further resistance force if it rotates backwards relative to the base 702, but more often the brush rotates in a manner to pull the base 702 forward to thereby negate some or, in extreme cases (e.g., very low carpet with high friction between the carpet and the rotating brush), all of the resistance.

As the typical vacuum cleaner 700 is moved on a carpeted surface, the front and rear wheels 710, 708 experience an increased rolling resistance, resulting in a higher operating force $F_1$. When suction lock is added, the total operating force $F_1$ can become extremely high. Under these circumstances, it would be desirable to allow the suction inlet 714 to freely float on the carpet surface to reduce the effect of suction lock. Contact between the bottom surface of the base 702 and the carpet (particularly if there is a large skid plate) could generate a force to push the suction inlet 714 upwards to provide the desired float, but it has been found that this force appears insufficient to reduce suction lock and alleviate the generation of a high operating force $F_1$, particularly in dense carpets. Instead, it is believed that a large rotational moment M generated between the rear wheel 708 and the handle pivot 706 (which are spaced apart by a fixed distance d to provide stability) forces the base 702, including the front wheel 710 and suction inlet 714 into the carpet, further increasing the resistance forces opposing the horizontal vector component $F_H$. (A similar moment may be generated between the front wheel 710 and the handle pivot 706.) The problem can be magnified by several factors. For example, carpet may catch on the back edge of the suction inlet 714. As another example, the front wheels 710 may be relatively small to fit under the base 702, and therefore subject to significantly higher rolling resistance than a larger wheel would be when encountering the carpet piles. Still further, the force necessary to float the suction inlet 714 must be large enough to raise most of the base 702, the front wheels 710, the wheel carriage 712, and even the handle (i.e., everything in front of the rear wheel pivot). Even a very large skid plate may not be able to generate sufficient force to overcome the rotational moment M and lift all of the parts to provide enough float to mitigate the suction lock.

Stated simply, the configuration of the conventional vacuum cleaner 700 couples the operating force $F_1$ to the base 702 in such a way that the operating force $F_1$ pushes the suction inlet 714 into the carpet, making it impossible for the suction inlet 714 to float freely, and increasing the total resistance to movement. It is noted that some conventional vacuum cleaners may be constructed such that they do not experience the foregoing phenomenon. For example, the device shown in U.S. Pat. No. 3,031,710 (which is incorporated herein by reference) avoids the generation of a moment M to press the base downward by making the inlet nozzle and rear wheel pivot about the handle's pivot axis. However, this device lacks any kind of manual height adjustment, and the rear wheel is not spaced from the handle pivot and therefore does not provide the degree of support that is desirable in, and expected of, modern vacuum cleaners.

It has been found that the foregoing problems can be mitigated, without sacrificing stability, by providing a suction inlet that can move up and down ("float"), even when the vacuum cleaner is being pushed forward by an operating force $F_1$. FIGS. 1-6 illustrate an example of an upright vacuum cleaner 100 having an inlet nozzle assembly 201 that is essentially decoupled from the rotational moment created when an operator pushes on the vacuum cleaner handle 104. This construction is believed to require a relatively low operating force to move the vacuum cleaner 100 over certain carpet surfaces, such as dense carpets.

As explained above, the exemplary vacuum cleaner 100 comprises an inlet nozzle assembly 201, a carriage 200, and a handle 104. The handle 104 is pivotally mounted on the carriage 200, and the carriage 200 has rear wheels 708 and front wheels 710 that support the weight of the handle 104. The inlet nozzle assembly 201, which carries the suction inlet 206, is pivotally mounted to the handle 104, and moves generally independently from the carriage 200. The carriage 200 and inlet nozzle assembly 201 may be functionally connected by a height-adjusting knob 248, which sets a minimum height of the inlet nozzle assembly 201 relative to the carriage 200. An optional spring 272 may be provided to pull the inlet nozzle assembly 201 towards the carriage 200. The inlet nozzle assembly 201 is free to rise relative to the carriage 200 upon the application of an upward force, provided the force is sufficient to stretch the spring 272 if one is provided.

FIGS. 4A-4C show, in cross-section, the movement of the inlet nozzle assembly 201 relative to the rest of the vacuum cleaner 100. In these Figures, the movement is caused by the liftoff lever 260, but a similar motion occurs when the inlet nozzle assembly 201 is raised by other forces. Thus, these Figures are sufficient to illustrate the manner in which the inlet nozzle assembly 201 raises and lowers with respect to the carriage 200.

Figure 8:
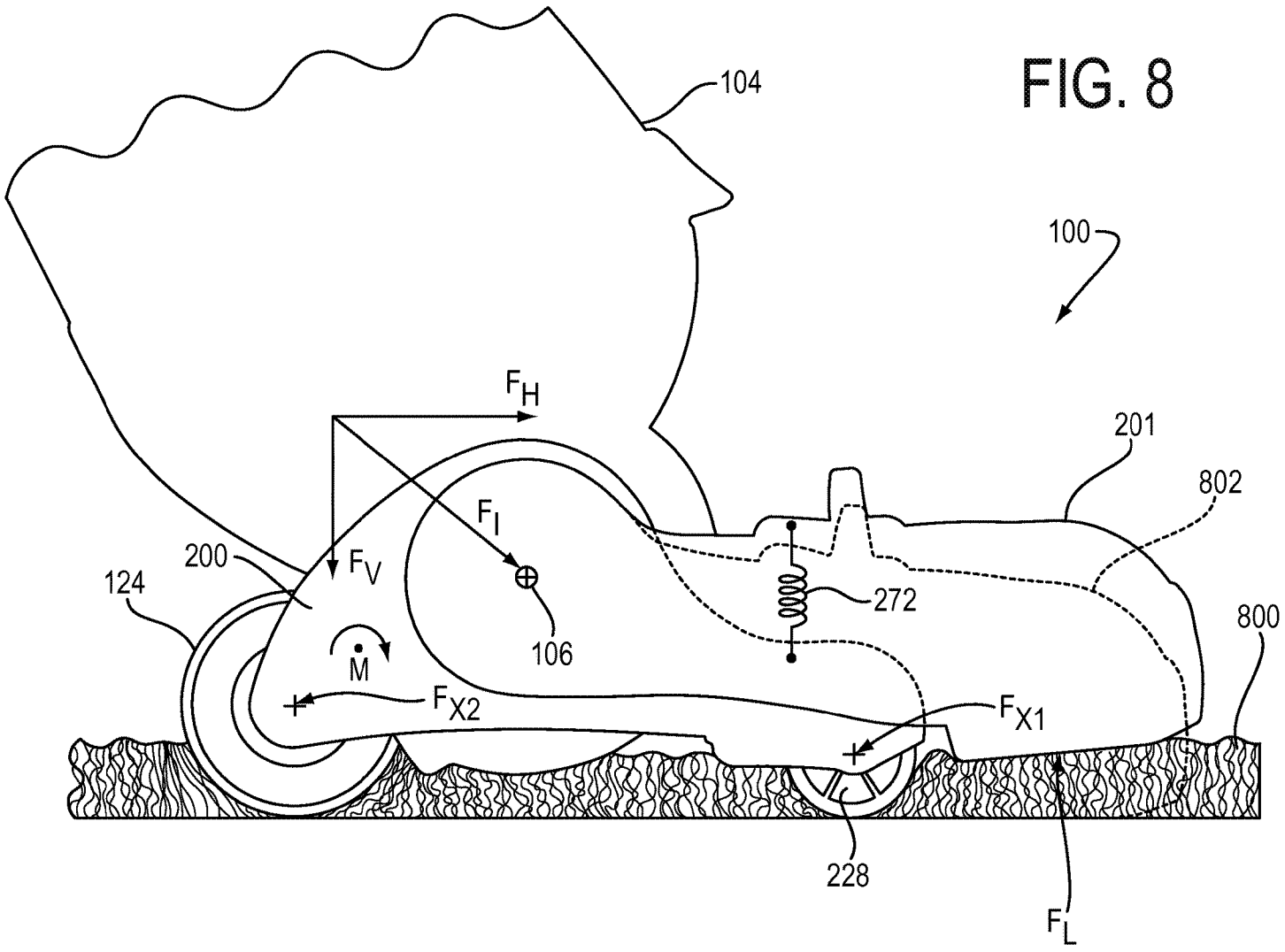
FIG. 8 is a side view of the vacuum cleaner of FIG. 1.

FIG. 8 illustrates the operation of the vacuum cleaner 100 of FIGS. 1-6 in high carpet 800. During the forward stroke, the operator pushes on the handle 104 to generate an operating force $F_1$. As before, this resolves into a downward vector $F_V$ and a horizontal vector $F_H$. The horizontal component $F_H$ is opposed by a first resistance force $F_{X1}$ at the front wheel 228, and a second resistance force $F_{X2}$ at the rear wheel 124. The magnitude of the resistance forces $F_{X1}$, $F_{X2}$ is likely to increase as the front and rear wheels 228, 124 sink into the carpet 800, such as shown. The foregoing forces collectively generate a rotating moment M that tends to rotate the carriage 200 forward about the handle pivot 106, which presses the front wheel 228 into the carpet 800.

Meanwhile, the inlet nozzle assembly 201 can pivot about the handle pivot axis 106 separately from the carriage 200. During the operation described above, the inlet nozzle assembly 201 is not directly driven into the carpet 800 by the moment M generated by the carriage 200, and the influence of the moment M on the inlet nozzle assembly 201 is limited to whatever force can be generated by the spring 272 (if one is provided). Under these circumstances, it is believed that contact between the lower surfaces of the inlet nozzle assembly 201 and the carpet 800 can generate a lifting force $F_L$ that is sufficient to elevate the inlet nozzle assembly 201 from a starting position (shown by dashed line 802) to a point where suction lock, friction between the inlet nozzle assembly 201 and the carpet 800, and other forces, are significantly reduced as compared to conventional devices, resulting in a greatly reduced operating force $F_1$ requirement. It will be understood that when the inlet nozzle assembly 201 is lifted as shown in FIG. 8, the bottom surface of the inlet nozzle assembly 201 may still press into the carpet surface, but with less force than would be present in a conventional design.

The degree of float may be regulated by, for example, altering the spring constant of the spring 272 (if provided) and changing the weight of the inlet nozzle assembly 201. Reducing the spring constant or making the inlet nozzle lighter are expected to reduce the operating force F1, but may result in reduced cleaning performance if taken to an extreme. The shape of the lower surface of the inlet nozzle assembly 201 also can affect the float properties. For example, a gently sloping surface 416 may be provided in advance of the suction inlet (see FIG. 4A) to encourage lifting upon contact with the carpet 800. Increasing the surface area in contact with the carpet 800 also may help induce float.

As will be apparent from the foregoing, constructing the inlet nozzle assembly 201 to rotate about the pivot axis 106 independently from the carriage 200 effectively decouples the dynamics of the inlet nozzle assembly 201 from the dynamics of the carriage 200. The spring 272 (when present) provides an operational dynamic link between the carriage 200 and the inlet nozzle assembly 201, but still permits independent rotation upon the application of sufficient force to deform the spring 272. (As used herein, "independent" and permutations thereof includes relative movement upon the application of a force to deform the spring 272.) The spring 272 may have constant or graduated spring rate. The spring 272 also may include slack to allow unrestricted relative movement before it is necessary to begin deforming the spring for further independent movement, or be preloaded to require a minimum predetermined force threshold before independent movement begins.

The exemplary spring 272 is a coil spring, operated in tension, and has a spring constant of approximately 6.7 pounds/inch. The spring 272 is mounted such that it expands in a direction parallel with the coil, so that its effective spring constant in operation is about the same as the rated spring constant. The spring 272 is mounted approximately 5.5 inches from the handle pivot axis 106, and the front of the inlet nozzle assembly 201 is about 8.5 inches from the handle pivot axis 106. This differential distance provides a leverage ratio of about 1.5:1 for a force $F_L$ applied at the front of the inlet nozzle assembly 201. For a spring 272 with an effective spring constant of 6.7 pounds/inch this results in a lifting force $F_L$ requirement of about 4.5 pounds per inch of travel (as used herein, the measure of the lifting force requirement excludes spring preload that may need to be overcome to begin movement, and the degree of such preload may depend on the position of a height adjustment mechanism). In other embodiments, the leverage ratio and spring constants may vary. It is expected that a lifting force $F_L$ requirement of 2.5 to 6.5, and more preferably 3.5 to 5.5, will provide favorable operation in various circumstances, and for relatively lightweight inlet nozzle assemblies. Heavier inlet nozzle assemblies may benefit from a lower lifting force $F_L$ requirement to allow the desired float, and lighter inlet nozzle assemblies may benefit from a heavier lifting force $F_L$ requirement to prevent significant degradation to the cleaning performance that might occur if the inlet is allowed to rise too far. It will be understood that the description herein and recitation in the claims of precise numerical values is done for expedience, and that operating embodiments may have some variation in the actual measured value due to measuring variations, manufacturing variances and minor inconsequential deviations introduced during the design process. Unless otherwise indicated, all values described and recited herein should be treated as target approximations (e.g., 4.5 pounds per inch will be understood by the person of ordinary skill in the art to be about 4.5 pounds per inch).

In the shown example, the inlet nozzle assembly 201 and the carriage 200 are collectively interconnected to the handle 104 by an arrangement of pivoting members (see FIG. 3B), but they may be separately connected to the handle 104 in other embodiments (e.g., by separate, radially-spaced bearings or bushings), if desired. In other embodiments, the inlet nozzle assembly 201 may be pivotally connected to the handle 104 indirectly by using the carriage 200 as an intermediate part, or vice versa. Other variations and modifications will be apparent to persons of ordinary skill in the art in view of the present disclosure.

It will be appreciated that it is not strictly necessary in all embodiments to mount the inlet nozzle assembly 201 to rotate about the handle pivot axis 106. For example, similar benefits may be obtained by mounting the carriage 200 on the handle 104 to rotate about the handle pivot axis 106, and mounting the inlet nozzle assembly 201 on the handle 104 to rotate about a second axis that is offset from the handle pivot axis 106. The second axis would be fixed with respect to the handle 104, which allows the use of a simple rigid air passage from the inlet nozzle assembly 201 to the handle 104 (such as shown in FIG. 3B). In such an embodiment, the inlet nozzle assembly 201 (and particularly the inlet 206) would move back and forth relative to the front and rear wheels 228, 124 as the handle 104 is rotated during use, and this may continuously flex any spring 272 that joins the two during use, but this may not present any problem with operation.

Furthermore, it is speculated that the inlet nozzle assembly 201 can be pivotally mounted to the carriage 200 at some location other than the handle pivot axis 106. However, this arrangement may more directly couple the motion of the inlet nozzle assembly 201 to the moment M created by the operating force $F_1$. This coupling affect may be reduced by mounting the inlet nozzle assembly 201 to pivot at a location closer to the rear wheels 124, which may increase the leverage applied by the lifting force $F_L$. Using a relatively low pivot location also may help mitigate the coupling affect, particularly if the pivot location is below the point of contact between the carpet 800 and the bottom of the inlet nozzle assembly 201 to thereby covert friction into a lifting moment. Mounting the inlet nozzle assembly 201 to pivot about a point on the carriage 200 other than the handle pivot axis 106 also would cause the inlet nozzle assembly 201 to pivot about an axis that is not fixed relative to the handle 104—that is, as the carriage 200 rotates relative to the handle 104, so too would the axis about which the inlet nozzle assembly 201 rotates. This would complicate efforts to provide a rigid air passage directly from the inlet nozzle assembly 201 to the handle 104 (a flexible hose could readily be used, however), but this arrangement could simplify the dynamics between the inlet nozzle assembly 201 and the carriage 200 as compared to embodiments described above that mount the inlet nozzle assembly 201 to rotate about a fixed axis on the handle 104 that is separate from the handle pivot axis.

It will be understood that the foregoing explanation is provided as a theoretical explanation for the improved performance of embodiments of the invention as compared to conventional devices. There may be other explanations for the discovered phenomena, and the invention is not intended to be bound by any theory of operation. It will also be understood that the foregoing embodiments may be modified in various other ways. For example, the carriage 200 may have any number of front and rear wheels 228, 124 (e.g., a single centrally-located front wheel instead of two spaced wheels), and these may be replaced or supplemented with other kinds of support, such as skids and the like. Also, the inlet nozzle assembly 201 may include its own wheels or other supports. Other variations and modifications will be apparent to persons of ordinary skill in the art in view of the present disclosure.

The present disclosure describes a number of new, useful and nonobvious features and/or combinations of features that may be used alone or together. The embodiments described herein are all exemplary, and are not intended to limit the scope of the inventions. It will be appreciated that the inventions described herein can be modified and adapted in various and equivalent ways, and all such modifications and adaptations are intended to be included in the scope of this disclosure and the appended claims.

We claim:

1. A vacuum cleaner comprising:

a handle having a first handle side and a second handle side opposite the first handle side;

a dirt separator mounted to the handle and having a separator inlet for receiving dirt-laden air and a separator outlet for discharging cleaned air;

a suction motor mounted in the handle and having a suction motor inlet, the suction motor being configured to generate a suction airflow into the suction motor inlet;

a nozzle having a bottom face, a first side region that extends along the first handle side, and a second side region that extends along the second handle side to thereby locate at least a portion of the handle between the first side region and the second side region;

a suction inlet passing through the bottom face of the nozzle, the suction inlet comprising an opening that is elongated along a suction inlet axis extending from the first side region to the second side region;

a pivot joining the nozzle to the handle at a pivot axis that extends from the first side region of the nozzle to the second side region of the nozzle and in parallel with the suction inlet axis, the pivot comprising a first pivot connection joining the first side region to the first handle side, and a second pivot connection joining the second side region to the second handle side;

wherein the nozzle comprises an upper shell and a lower shell that are joined together, the upper shell comprising an upper arm having a lower surface, the lower shell comprising a lower arm having an upper surface, wherein the lower surface of the upper arm faces the upper surface of the lower arm and the lower surface and the upper surface are connected at respective edges thereof to form an enclosed rigid base air passage extending from the suction inlet to the first pivot connection;

a first handle air passage located in the handle and extending from the first pivot connection to the separator inlet, the first handle air passage being fluidly connected to the base air passage through the first pivot connection;

a second handle air passage located in the handle and extending from the separator outlet to the suction motor inlet;

a carriage mounted to the nozzle and the handle to rotate relative to the nozzle and the handle, the carriage being configured to support the nozzle and the handle on a horizontal plane the carriage comprising a first side region adjacent to the first side region of the nozzle and a second side region adjacent to the second side region of the nozzle; and a storage lock assembly comprising a resiliently-deformable crossbeam and a protrusion, wherein the crossbeam comprising at least a portion that is substantially linear in shape and longitudinally extending between the first side region of the carriage and a second side region of the carriage, the portion of the crossbeam being deformable from the substantially linear shape, and the protrusion comprises an extension of the handle and rotates with the handle, the protrusion presses against and temporarily deforms the crossbeam when the handle is moved from an upright position to a reclined position or from the reclined position to the upright position.

2. The vacuum cleaner of claim 1, further comprising a brushroll rotatably mounted in the nozzle adjacent the suction inlet.

3. The vacuum cleaner of claim 2, wherein the second side region of the nozzle comprises a belt tunnel, and a belt is located in the belt tunnel to mechanically connect the brushroll to a drive shaft extending from the suction motor through the second pivot connection.

4. The vacuum cleaner of claim 1, wherein the first pivot connection comprises a generally circular mounting boss provided on one of the upper shell and the lower shell, the mounting boss including an opening therethrough to provide at least part of an airflow connection between the base air passage and the first handle air passage.

5. The vacuum cleaner of claim 1, wherein the first pivot connection comprises a nozzle mounting boss provided on the nozzle, the nozzle mounting boss comprising a hollow shaft forming at least part of an airflow connection between the base air passage and the first handle air passage.

6. The vacuum cleaner of claim 5, wherein the hollow shaft extends into the first handle air passage.

7. The vacuum cleaner of claim 6, wherein the hollow shaft comprises an outward flange that extends radially to contact the first handle air passage.

8. The vacuum cleaner of claim 5, wherein the hollow shaft extends along the pivot axis to provide a fluid connection that extends along the pivot axis from the base air passage to the first handle air passage.

9. The vacuum cleaner of claim 1, wherein the first handle air passage is fluidly connected to the base air passage through an opening that extends in a direction toward the pivot axis and through the center of the first pivot connection.

10. The vacuum cleaner of claim 1, wherein the suction motor is mounted in the handle with a rotating axis of the suction motor aligned with the pivot axis.

11. The vacuum cleaner of claim 10, wherein at least a portion of the first handle air passage is located on the pivot axis and between the suction motor and the first pivot connection, and at least a portion of the second handle air passage is located on the pivot axis and between the suction motor and the first pivot connection.

12. The vacuum cleaner of claim 11, wherein the second handle air passage is connected to the suction motor inlet at a location on the pivot axis between the suction motor and first pivot connection.

13. The vacuum cleaner of claim 1, wherein the base air passage extends straight and perpendicular to the suction inlet axis, from the suction inlet to the first pivot connection.

14. The vacuum cleaner of claim 13, wherein the base air passage is turned to direct the suction airflow along the pivot axis as the suction airflow passes from the base air passage to the first handle air passage.

15. The vacuum cleaner of claim 1, wherein the carriage comprises one or more wheels configured to support the nozzle and the handle on the horizontal plane.

16. The vacuum cleaner of claim 1, wherein the carriage is mounted to rotate about the pivot axis.

17. The vacuum cleaner of claim 16, wherein the carriage comprises one or more front wheels located on a first side of the pivot axis, and two rear wheels located on a second side of the pivot axis such that the pivot axis extends between the front wheels and the rear wheels, and wherein the front wheels are located, with respect to the horizontal plane, between the suction inlet and the pivot axis.

18. The vacuum cleaner of claim 1, further comprising a height adjustment assembly operatively connected between the nozzle and the carriage, and configured to selectively hold the suction inlet at a plurality of predetermined heights relative to the horizontal plane.

19. The vacuum cleaner of claim 1, further comprising:

a brushroll rotatably mounted in the nozzle adjacent the suction inlet, and a liftoff lever operatively connected between the nozzle and the carriage, and configured to lift the brushroll out of contact with the horizontal plane when the handle is rotated to a predetermined position with respect to the nozzle.

20. The vacuum cleaner of claim 1, wherein the carriage is mounted to the nozzle and the handle by a first mounting ring that is operatively connected with the first pivot connection, the first mounting ring comprising an opening through which the first handle air passage is fluidly connected to the base air passage.

21. The vacuum cleaner of claim 1, wherein the first pivot connection comprises:

a first handle mounting boss provided as part of the first side of the handle;

a first mounting ring provided as part of the carriage and surrounding the first handle mounting boss;

a first nozzle mounting boss provided as part of the first side region of the nozzle and located within the first mounting ring; and wherein the base air through the first handle mounting boss passage is fluidly connected to the first handle air passage mounting boss, the first mounting ring, and the first nozzle mounting boss.

22. The vacuum cleaner of claim 21, wherein:

the first mounting ring comprises an annular ring flange formed within the first mounting ring;

the first nozzle mounting boss comprises a nozzle flange formed outside the first nozzle mounting boss; and the ring flange engages the nozzle flange to hold the first nozzle mounting boss in the first mounting ring.

23. The vacuum cleaner of claim 22, wherein:

the nozzle flange comprises a nozzle flange gap;

the ring flange comprises a ring flange gap; and the nozzle flange, nozzle flange gap, ring flange, and ring flange gap are configured such that the nozzle flange can pass through the ring flange gap and the ring flange can pass through the nozzle flange gap to permit the first nozzle mounting boss to be removed from the first mounting ring upon rotating the nozzle to a predetermined position relative to the carriage, whereby in the predetermined position the nozzle flange is oriented to pass through the ring flange gap and the ring flange is oriented to pass through the nozzle flange gap.

24. The vacuum cleaner of claim 1, wherein the second pivot connection comprises:

a second handle mounting boss provided as part of the second side of the handle;

a second mounting ring provided as part of the carriage and surrounding the second handle mounting boss; and a second nozzle mounting boss provided as part of the second side region of the nozzle and located within the second mounting ring.

25. The vacuum cleaner of claim 24, wherein:

the second mounting ring comprises an annular ring flange formed within the second mounting ring;

the second nozzle mounting boss comprises a nozzle flange formed outside the second nozzle mounting boss; and the ring flange engages the nozzle flange to hold the second nozzle mounting boss in the second mounting ring.

26. The vacuum cleaner of claim 25, wherein:

the nozzle flange comprises a nozzle flange gap;

the ring flange comprises a ring flange gap; and the nozzle flange, nozzle flange gap, ring flange, and ring flange gap are configured such that the nozzle flange can pass through the ring flange gap and the ring flange can pass through the nozzle flange gap to permit the second nozzle mounting boss to be removed from the second mounting ring upon rotating the nozzle to a predetermined position relative to the carriage, whereby in the predetermined position the nozzle flange is oriented to pass through the ring flange gap and the ring flange is oriented to pass through the nozzle flange gap.

27. The vacuum cleaner of claim 26, wherein the nozzle flange gap comprises two nozzle flange gaps, and the ring flange gap comprises two ring flange gaps.

28. The vacuum cleaner of claim 1, wherein the carriage comprises a frame, an opening is defined between two opposite sides of the frame, the crossbeam extends laterally across the opening behind the pivot axis; the crossbeam is formed as a flexible spar and a relatively rigid spar, and the flexible spar and the rigid spar are formed by dividing the crossbeam with a laterally-elongated slot.

29. A vacuum cleaner comprising:

a handle having an upper end, a lower end, a first handle side, and a second handle side opposite the first handle side;

a dirt separator mounted to the handle, the dirt separator having a separator inlet for receiving dirt-laden air and a separator outlet for discharging cleaned air;

a handle air passage formed in the handle, the handle air passage having a handle air passage inlet located at the first handle side at the lower end of the handle, and a handle air passage outlet connected to the separator inlet;

a suction motor mounted in the handle, the suction motor having a suction motor inlet connected to the separator outlet;

a nozzle shell having:

a bottom face with an elongate suction inlet passing through the bottom face of the nozzle shell;

a first side arm that extends backwards from the suction inlet and forms a first pivot connection to pivotally connect the nozzle shell to the first handle side at the lower end of the handle;

a second side arm that extends backwards from the suction inlet and pivotally connects the nozzle shell to the second handle side at the lower end of the handle; and the nozzle shell including an upper shell and a lower shell that are joined together to form a rigid nozzle air passage, the rigid nozzle air passage formed in the first side arm by the joining of the upper shell and the lower shell, the rigid nozzle air passage extending backwards from the suction inlet to the first pivot connection of first handle side at the lower end of the handle and having a nozzle air passage inlet connected to the elongate suction inlet, and a nozzle air passage outlet connected to the handle air passage inlet, whereby the suction motor draws dirt-laden air into the suction inlet, through the nozzle air passage and the handle air passage and into the dirt separator; and a first nozzle mounting boss provided as part of the nozzle shell, the first nozzle mounting boss having a nozzle flange formed outside the first nozzle mounting boss, the nozzle flange defining a nozzle flange gap; and a carriage mounted to the nozzle shell and the handle to rotate relative to the nozzle shell and the handle, the carriage being configured to support the nozzle shell and the handle on a horizontal plane, the carriage having a first side region adjacent to the first side region of the nozzle and a second side region adjacent to the second side region of the nozzle and a first mounting ring with a ring flange formed within the first mounting ring, the ring flange defining a ring flange gap;

wherein the nozzle flange, the nozzle flange gap, the ring flange, and the ring flange gap are configured such that upon rotating the nozzle to a predetermined position relative to the carriage the nozzle flange is oriented to pass through the ring flange gap and the ring flange is oriented to pass through the nozzle flange gap, such that the first nozzle mounting boss is permitted to be removed from the first mounting ring by passing the nozzle flange through the ring flange gap and the ring flange through the nozzle flange gap; and a storage lock assembly comprising a resiliently-deformable crossbeam and a protrusion, wherein the crossbeam comprising at least a portion that is substantially linear in shape and longitudinally extending between the first side region of the carriage and a second side region of the carriage, the portion of the crossbeam being deformable from the substantially linear shape, and the protrusion comprises an extension of the handle and rotates with the handle, the protrusion presses against and temporarily deforms the crossbeam when the handle is moved from an upright position to a reclined position or from the reclined position to the upright position.

30. The vacuum cleaner of claim 29, wherein the nozzle shell comprises a rigid structure, and the rigid nozzle air passage is integrally formed with the first side arm.

31. The vacuum cleaner of claim 29, wherein the nozzle air passage comprises a smooth passage from the nozzle air passage inlet to the nozzle air passage outlet.

32. The vacuum cleaner of claim 31, wherein the nozzle shell comprises:

a shell including the nozzle and forming a lower portion of an inlet nozzle; and an upper shell forming an upper portion of the inlet nozzle.

33. A vacuum cleaner comprising:

a handle having a first handle side and a second handle side opposite the first handle side;

a dirt separator mounted to the handle and having a separator inlet for receiving dirt-laden air and a separator outlet for discharging cleaned air, a suction motor mounted in the handle and having a suction motor inlet, the suction motor being configured to generate a suction airflow into the suction motor inlet, a nozzle having a bottom face, a first side region that extends along the first handle side, and a second side region that extends along the second handle side to thereby locate at least a portion of the handle between the first side region and the second side region;

a suction inlet passing through the bottom face of the nozzle, the suction inlet comprising an opening that is elongated along a suction inlet axis extending from the first side region to the second side region;

a pivot joining the nozzle to the handle at a pivot axis that extends from the first side region of the nozzle to the second side region of the nozzle and in parallel with the suction inlet axis, the pivot comprising a first pivot connection joining the first side region to the first handle side, and a second pivot connection joining the second side region to the second handle side;

wherein the nozzle comprises an upper shell and a lower shell that are joined together, the upper shell comprising an upper arm having a lower surface, the lower shell comprising a lower arm having an upper surface, wherein the lower surface of the upper arm faces the upper surface of the lower arm and the lower surface and the upper surface are connected at respective edges thereof to form an enclosed rigid base air passage extending from the suction inlet to the first pivot connection, a first arm in the first side region, and a second arm in the second side region, the enclosed rigid nozzle air passage being formed in the first side arm by joining together the upper shell and the lower shell;

a first handle air passage located in the handle and extending from the first pivot connection to the separator inlet, the first handle air passage being fluidly connected to the base air passage through the first pivot connection, the first side region of the nozzle including a first nozzle mounting boss, the first nozzle mounting boss having a nozzle flange formed outside the first nozzle mounting boss, the nozzle flange defining a nozzle flange gap; and a second handle air passage located in the handle and extending from the separator outlet to the suction motor inlet;

a carriage mounted to the nozzle and the handle to rotate relative to the nozzle and the handle, the carriage being configured to support the nozzle and the handle on a horizontal plane, the carriage having a first side region adjacent to the first side region of the nozzle and a second side region adjacent to the second side region of the nozzle and a first mounting ring with a ring flange formed within the first mounting ring, the ring flange defining a ring flange gap:

wherein the nozzle flange, the nozzle flange gap, the ring flange, and the ring flange gap are configured such that upon rotating the nozzle to a predetermined position relative to the carriage the nozzle flange is oriented to pass through the ring flange gap and the ring flange is oriented to pass through the nozzle flange gap, such that the first nozzle mounting boss is permitted to be removed from the first mounting ring by passing the nozzle flange through the ring flange gap and the ring flange through the nozzle flange gap; and a storage lock assembly comprising a resiliently-deformable crossbeam and a protrusion, wherein the crossbeam comprising at least a portion that is substantially linear in shape and longitudinally extending between the first side region of the carriage and a second side region of the carriage, the portion of the crossbeam being deformable from the substantially linear shape, and the protrusion comprises an extension of the handle and rotates with the handle, the protrusion presses against and temporarily deforms the crossbeam when the handle is moved from an upright position to a reclined position or from the reclined position to the upright position.

* * * * *